US010288381B1

(12) United States Patent
Sirot et al.

(10) Patent No.: US 10,288,381 B1
(45) Date of Patent: May 14, 2019

(54) APPARATUS, SYSTEM, AND METHOD FOR FIREARMS TRAINING

(71) Applicant: 910 Factor, Inc., Fayetteville, NC (US)

(72) Inventors: Christophe Pierre Franklin Sirot, San Francisco, CA (US); Keith Gates, Fayetteville, NC (US); Jean Louis Alexief, Maing (FR)

( * ) Notice: Subject to any disclaimer, the term of this patent is extended or adjusted under 35 U.S.C. 154(b) by 0 days.

(21) Appl. No.: 16/126,848

(22) Filed: Sep. 10, 2018

Related U.S. Application Data

(63) Continuation of application No. 16/015,546, filed on Jun. 22, 2018.

(51) Int. Cl.
*F41G 3/26* (2006.01)
*F41J 5/06* (2006.01)
*F41J 11/00* (2009.01)

(52) U.S. Cl.
CPC ..... *F41G 3/26* (2013.01); *F41J 5/06* (2013.01); *F41J 11/00* (2013.01)

(58) Field of Classification Search
CPC ..... F41A 33/00; F41A 33/02; F41A 33/04; F41A 33/06; F41J 5/06; F41J 5/14; F41J 5/042; F41J 11/00; F41J 2/00; H04W 4/80
See application file for complete search history.

(56) References Cited

U.S. PATENT DOCUMENTS

| | | | | |
|---|---|---|---|---|
| 4,799,688 | A | 1/1989 | Kellman | |
| 5,551,876 | A | 9/1996 | Koresawa | |
| 5,816,817 | A | 10/1998 | Tsang | |
| 8,126,838 | B2 | 2/2012 | Stone | |
| 8,186,109 | B2 | 5/2012 | Warminsky | |
| 8,360,776 | B2 | 1/2013 | Manard | |
| 8,597,026 | B2 | 12/2013 | Cincotti | |
| 9,004,490 | B2 * | 4/2015 | Kazakov | F41J 5/06 273/372 |
| 9,250,039 | B2 | 2/2016 | Matthews | |
| 9,267,762 | B2 | 2/2016 | Northrup | |
| 9,453,711 | B2 | 9/2016 | Martin | |
| 2011/0300514 | A1 | 12/2011 | Didier | |
| 2012/0156652 | A1 | 6/2012 | Lane | |
| 2012/0274922 | A1 | 11/2012 | Hodge | |
| 2016/0138895 | A1 * | 5/2016 | Beine | F41J 5/02 434/19 |
| 2017/0176127 | A1 * | 6/2017 | Ferris | F41A 33/02 |
| 2018/0028917 | A1 * | 2/2018 | Poerschke | A63F 13/537 |

* cited by examiner

*Primary Examiner* — Timothy A Musselman
(74) *Attorney, Agent, or Firm* — James M. Smedley LLC; James Michael Smedley, Esq.

(57) ABSTRACT

A system is disclosed. The system has a target assembly having a reflective surface, a plurality of acoustic sensors disposed at the target assembly, and at least one optical sensor. The target assembly includes sound-absorbing material. The at least one optical sensor is configured to image a plurality of users of the system.

25 Claims, 17 Drawing Sheets

APPARATUS, SYSTEM, AND METHOD FOR FIREARMS TRAINING

RELATED APPLICATIONS

This application claims the benefit of U.S. Nonprovisional patent application Ser. No. 16/015,546 filed on Jun. 22, 2018, which is hereby incorporated by reference in their entirety.

FIELD OF THE INVENTION

The present disclosure generally relates to an apparatus, system, and method for training, and more particularly to an apparatus, system, and method for firearms training.

BACKGROUND OF THE INVENTION

Conventional scenario-based firearms training typically involves a high level of risk-taking and/or may be costly in terms of time and resources. Also, conventional scenario-based firearms training typically does not accomplish most or all training goals. For example, virtual reality training usually involves a "video game" approach lacking realism, having features such as fake weapons and wearable electronics. Approaches using simulated guns and cinematic apparatuses utilize video-based scenarios lacking real shooting and also lacking interaction with other shooters. The approaches also involve considerable costs.

Conventional tactical shooting sequences involve working on student physicality to create exhaustion, e.g., by focusing on a student's cognitive system through elaborate confusion-inducing exercises or by enhancing an environment to create atmospherics (e.g., that may be taxing to a system). Such intense approaches usually involve safety issues as training becomes more realistic. Also, such approaches typically lack actual interaction with other shooters. Conventional reflective target set-ups do not offer accurate shot tracking and placement analysis, and therefore lack measures for meaningful evaluation of student performance.

The exemplary disclosed system and method are directed to overcoming one or more of the shortcomings set forth above and/or other deficiencies in existing technology.

SUMMARY OF THE INVENTION

In one exemplary aspect, the present disclosure is directed to a system. The system includes a target assembly having a reflective surface, a plurality of acoustic sensors disposed at the target assembly, and at least one optical sensor. The target assembly includes sound-absorbing material. The at least one optical sensor is configured to image a plurality of users of the system.

In another aspect, the present disclosure is directed to a method. The method includes using a reflective surface of a target assembly to reflect an image of a first user at a first location to be visible on the reflective surface to a second user at a second location, acoustically sensing a bullet impact location point on the target assembly of a bullet fired from a firearm of the second user, and optically sensing a location of the first user and the second user.

DETAILED SPECIFICATION

Figure 1:
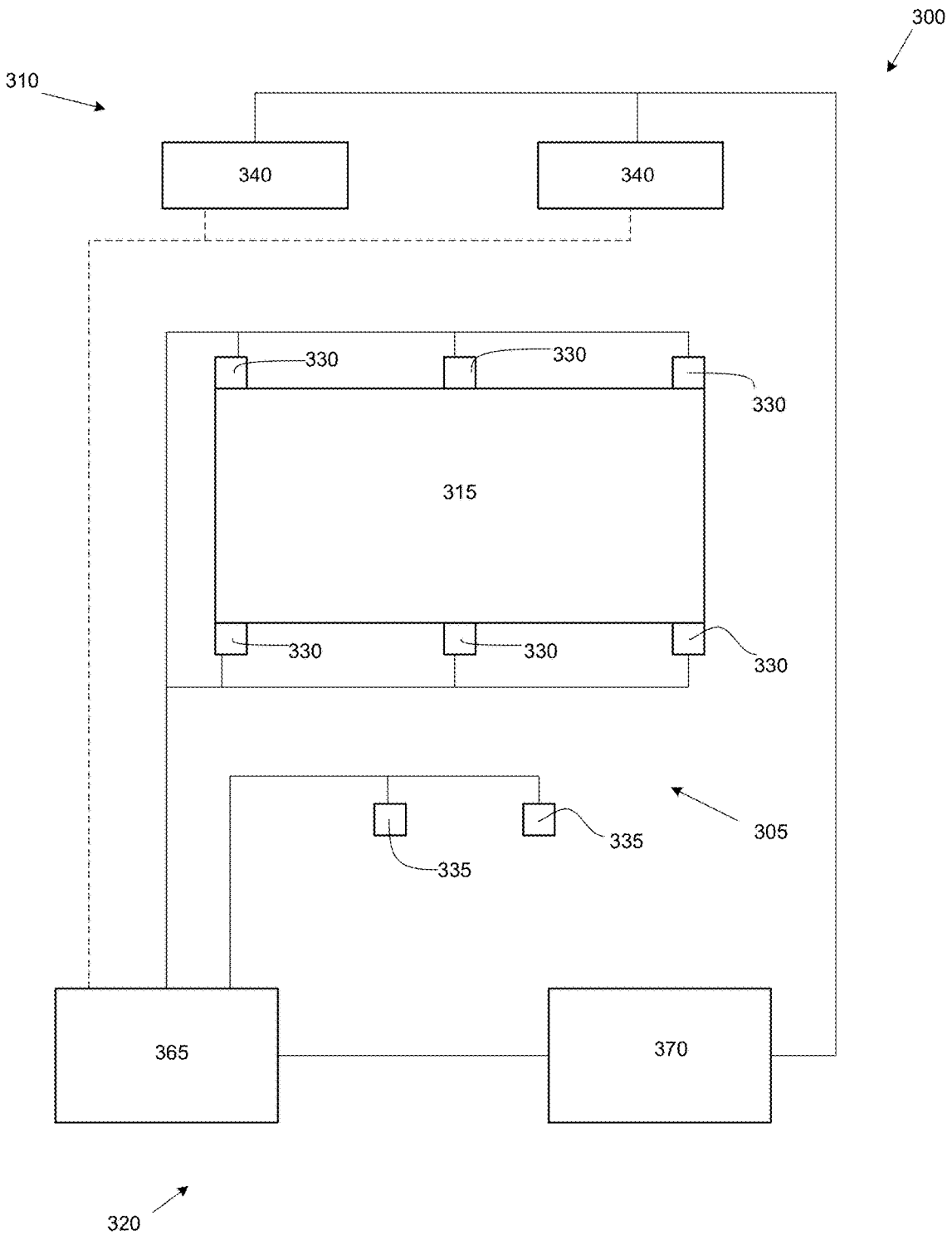
FIG. 1 is a schematic illustration of an exemplary system of the present invention.

FIG. 1 illustrates an exemplary system 300 for firearms training. System 300 may be used in any suitable application for live-fire training of firearms and/or professional training of personnel. For example, system 300 may be used in any suitable application for tactical training of military, police, security force personnel, and/or any other firearm users in using their respective service or personal weapons. In at least some exemplary embodiments, system 300 may be an impact shot tracking system.

System 300 may include an acoustic sensor array 305, an optical sensor array 310, a target assembly 315, and an analysis system 320. Data collected by acoustic sensor array 305 and optical sensor array 310 may be utilized by analysis system 320 to determine an impact of a user firearm on target assembly 315. Acoustic sensor array 305, optical sensor array 310, and target assembly 315 may be installed in a training range 325.

Acoustic sensor array 305 may include one or more impact sensors 330 and one or more trigger sensors 335. As described for example below, one or more impact sensors 330 may be disposed around target assembly 315, and one or more trigger sensors 335 may be disposed in an area of training range 325.

One or more impact sensors 330 may be any suitable sensor for locating a position of an impact of a projectile on target assembly 315. For example, impact sensor 330 may be any suitable sensor that may be disposed near, around, and/or within target assembly 315 and that may detect the location at which a projectile such as a bullet fired by a firearm may strike target assembly 315. One or more impact sensors 330 may be any suitable acoustic triangulation device. One or more impact sensors 330 may form a microphone array that may be used to triangulate a location of an impact of a projectile on target assembly 315. A plurality of impact sensors 330 (e.g., six or any other desired number or configuration of impact sensors 330) may be disposed around target assembly 315 as described for example below. As described below, target assembly 315 may be formed in such a way as to create a characteristic noise when a projectile such as a bullet strikes target assembly 315, which may be detected by one or more impact sensors 330. For example, one or more impact sensors 330 may be one or more microphones mounted around target assembly 315 as illustrated for example in FIG. 2. One or more impact sensors 330 may be any suitable sensors (e.g., acoustic sensors such as microphones) that may determine a location (e.g., coordinates such as x,y coordinates as described below) of an impact of a projectile on target assembly 315, e.g., by triangulation. It is also contemplated that one or more sensors 330 may determine a location of an impact of a projectile by any suitable alternative technique from triangulation such as, for example, based on collecting data associated with any suitable aspects of a firearm and/or projectile fired from a firearm.

Any suitable firearm for training may be used with system 300. For example, a user may use his or her service weapon (e.g., service firearm) or personal weapon with live ammunition. Weapons such as pistols, rifles, and/or any other desired firearm having any suitable caliber and/or other desired features may be used. Weapons using bullets of any suitable dimension and characteristics may be used with system 300.

Figure 2:
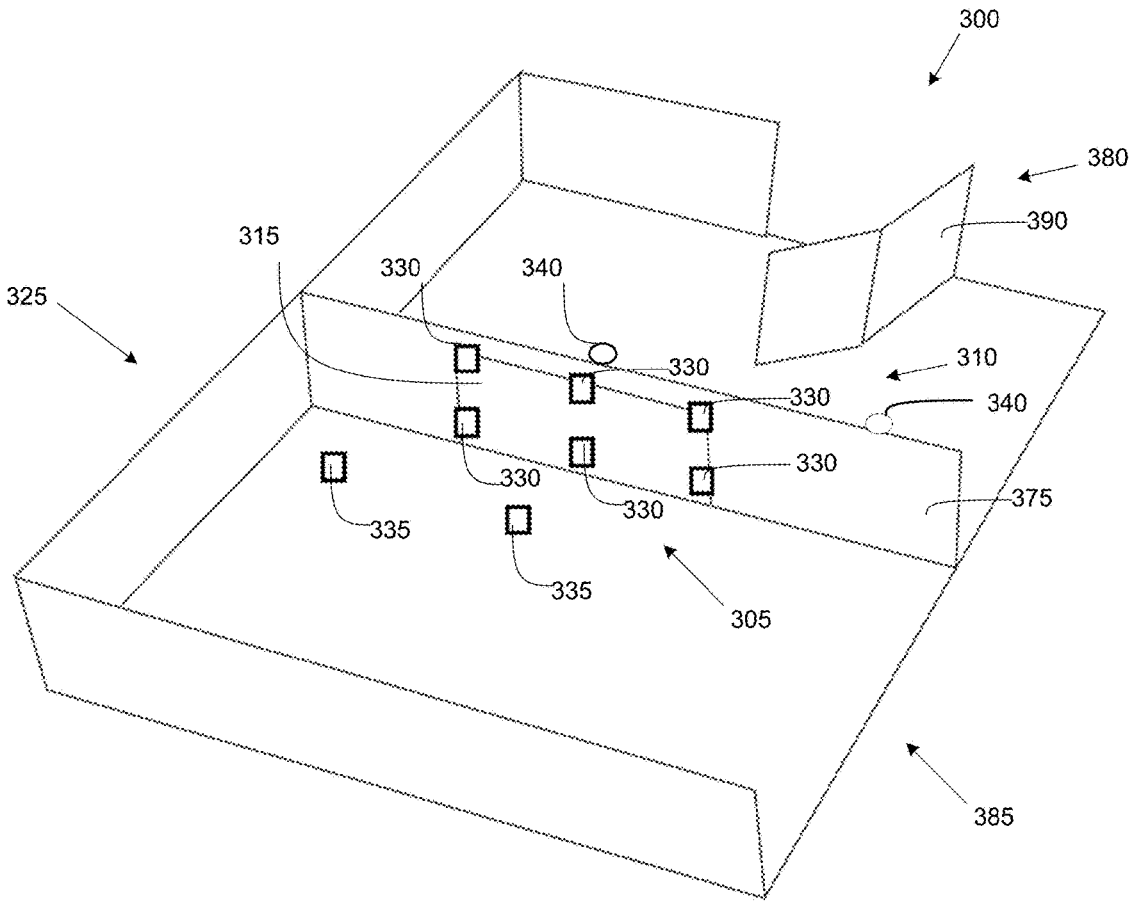
FIG. 2 is a perspective schematic illustration of an exemplary embodiment of the present invention.

One or more trigger sensors 335 may be any suitable sensors (e.g., acoustic sensors) for determining a time at which a firearm is fired (e.g., shot start of a projectile such as a bullet) and/or a time of arrival ("TOA") of a projectile impacting target assembly 315. For example, one or more trigger sensors 335 may open a "window of measurement" for acoustic sensor array 305 to sense target assembly 315, which may permit data recording by acoustic sensor array 305 at the desired time frame (e.g., as the exemplary method may be focused on a narrow noise frequency to discern the recorded data from blast noise saturation and impact noise on target assembly). Also for example, TOA may be relevant to an exemplary triangulation method utilized by system 300 (e.g., the TOA for the impact noise to acoustic sensor array 305 may allow for triangulation positioning). It is also contemplated that either or both of sensors 330 and/or 335 may determine a location of impact of a projectile on target assembly 315, a shot start, and/or a time of arrival. One or more trigger sensors 335 may for example be any suitable microphone sensors for determining a shot start time of a projectile. As illustrated in FIG. 2, one or more trigger sensors 335 may be disposed in front of target assembly 315. For example, a pair of trigger sensors 335 (e.g., or any other desired number of trigger sensors 335) may be disposed in front of target assembly 315. One or more trigger sensors 335 may be disposed in a vicinity of a user who is a shooter on training range 325 as described below. In at least some exemplary embodiments, one or more trigger sensors 335 may initiate a measuring sequence (e.g., the measuring sequence may be triggered by the detected gunshot). One or more trigger sensors 335 may be positioned in front of target assembly 315 (e.g., with the area represented behind this position being a virtual space and/or symmetrical space as viewed from a point of view of a user such as a trainee).

Optical sensor array 310 may include one or more optical sensors 340. One or more optical sensors 340 may be any suitable sensors for determining a location of shot origination of a projectile such as a bullet and a location of a target (e.g., a user acting as a target and/or a target reflection) as described below. For example, one or more optical sensors 340 may be any suitable sensor for imaging and/or determining a position of a barrel of a weapon (e.g., firearm) used by a user and/or an actual target (e.g., role-playing user) or reflected target of a user as described for example herein. In at least some exemplary embodiments, optical sensor 340 may be a stereoscopic camera and/or any other suitable device for stereo photography, stereo videography, and/or stereoscopic vision. Optical sensor 340 may be a three-dimensional video sensor. One or more optical sensors 340 may include a plurality of cameras or a single camera configured to collect three-dimensional image data. One or more optical sensors 340 may be disposed in training range 325 as described for example below. In an exemplary embodiment and as illustrated in FIG. 2, a pair of optical sensors 340 may be mounted at an upper portion of a frame supporting target assembly 315. Optical sensors 340 may for example image and collect location data of users of system 300, as described for example below.

It is also contemplated that any of sensors 330, 335, and/or 340 may be any desired type of sensor such as, for example, an acoustic sensor, an optical sensor, a thermal sensor, a pressure sensor, an infrared sensor, an ultrasonic sensor, an accelerometer, and/or any other suitable sensor for collecting the exemplary data described herein.

Figure 3:
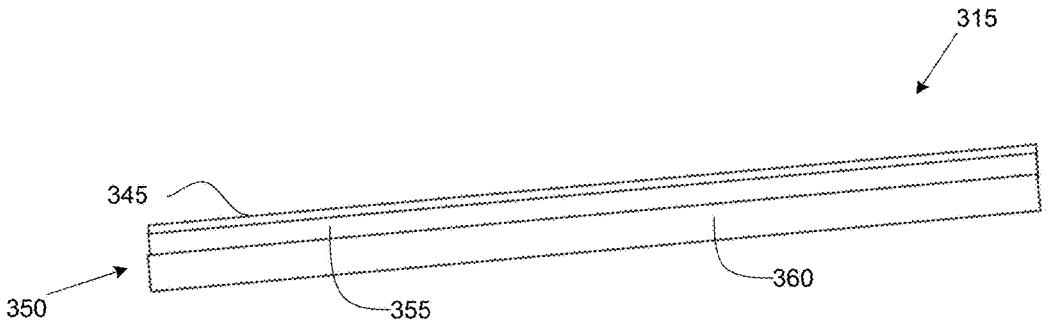
FIG. 3 is a perspective schematic illustration of an exemplary embodiment of the present invention.

Target assembly 315 may be any suitable assembly for reflecting a target image as described for example herein and/or for creating a characteristic noise from an impact of a projectile that can be located (e.g., by triangulation) based on an operation of acoustic sensor array 305. As illustrated in FIG. 3, target assembly 315 may include a reflective layer 345 that may be attached to (e.g., mounted on) an acoustic layer 350.

Reflective layer 345 may be any suitable material for reflecting an image. For example, reflective layer 345 may be a reflective film formed from any suitable reflective material. For example, reflective layer 345 may be a polyester film such as a metalized polyester film. For example, reflective layer 345 may be any suitable metalized plastic film. Also for example, reflective layer 345 may be any film having a suitable thickness and/or tear mitigation coating properties for use on target assembly 315.

Acoustic layer 350 may be any suitable layer for creating a characteristic noise that may be utilized by acoustic sensor array 305 to determine a location of impact of a projectile such as a bullet striking target assembly 315. Acoustic layer 350 may be for example an acoustic screen including a plurality of layers. For example, acoustic layer 350 may include an absorbing layer 355 and a plate member 360. Absorbing layer 355 may be any suitable material for substantially preventing an echoing of sound caused by an impact of a projectile on target assembly 315. For example, absorbing layer 355 may include any suitable sound-absorbing material such as porous material (e.g., foam material), textile material, acoustic composite material, and/or any other suitable material for absorbing sound. For example, absorbing layer 355 may include mineral wool material such as stone wool, slag wool, glass wool, and/or ceramic fiber. For example, absorbing layer 355 may be Rockwool™ insulation. Absorbing layer 355 may include any suitable material for isolating impact noise of a projectile striking plate member 360 from a shot noise of a firearm firing that projectile and/or a blast (e.g., subsonic, transonic, and/or supersonic blast depending for example on a caliber and velocity of the projectile) associated with the projectile. Absorbing layer 355 may be an acoustic insulation layer (e.g., sound insulation layer). Plate member 360 may be any suitable structural material for use in an acoustic layer such as, for example, plastic material, composite material, and/or any other suitable material for supporting sound-absorbing material. For example, plate member 360 may be an impact plate. In at least some exemplary embodiments, reflective layer 345 and acoustic layer 350 may be formed from transparent and/or translucent materials. Target assembly 315 may be of any suitable dimensions and/or configuration for use in a live-fire training exercise using firearms. For example, target assembly 315 may be between about 2 meters and about 5 meters wide and between about 1 meter and about 3 meters in height (e.g., about 3 meters wide by about 2 meters in height), and/or any other desired width and height. Target assembly 315 may for example be disposed at between about 2 meters and about 20 meters from an entrance to training range 325 (e.g., between about 4 meters and about 15 meters inside training range 325). Reflective layer 345, absorbing layer 355, and plate member 360 may be integrally formed as a single unit. Alternatively for example, reflective layer 345, absorbing layer 355, and plate member 360 may be modular components that may be assembled together to form target assembly 315 by a user. Also for example, target assembly 315 may be formed as a cassette-type unit including two components (e.g., two of reflective layer 345, absorbing layer 355, and plate member 360) that are integrally formed with the third component attachable (e.g., insertable) by a user.

Returning to FIG. 1, analysis system 320 may be any suitable system for controlling an operation of system 300 as described for example herein. Analysis system 320 may include components similar to the exemplary components disclosed below regarding FIGS. 18 and 19. For example, analysis system 320 may include one or more modules having computer-executable code stored in non-volatile memory. Analysis system 320 may also include a processor for processing data associated with system 300 as disclosed herein that may be partially or substantially entirely integrated into any component (e.g., or combination of components) of system 300. Analysis system 320 may serve as an electronic signal acquisition module that me include a computing device disposed in a control room located adjacent to (e.g., or remotely located from) training range 325. Analysis system 320 may include a suitable power supply (e.g., +/−12V+5V), an analog signal conditioning unit, and a digital processing unit.

In at least some exemplary embodiments, analysis system 320 may include components 365 and/or 370. For example, component 365 may include hardware for controlling an operation of acoustic sensor array 305 and/or for synchronizing an operation of acoustic sensor array 305 and optical sensor array 310. Component 365 may include hardware that may provide for shooting detection, microphone signal formatting of acoustic sensor array 305, camera synchronization of optical sensor array 310 with other components of system 300, and/or microphone signal acquisition and storage for acoustic sensor array 305. Component 370 may include a computing device and software that may be similar to the exemplary computing device and software described below regarding FIG. 18. Component 370 may control an operation of optical sensor array 310. For example, component 370 may provide system setting functions, acoustic functions (e.g., recording shot sequence and/or computing X,Y impact position by triangulation as described for example herein), vision functions (e.g., recording image when shooting and/or XYZ room calibration as described for example herein), and/or shooting scene reconstruction (e.g., matching shot impact-image, locating users such as a trainee and a target, and/or computing a virtual shot line). Components 365 and 370 may be connected via a USB connection and/or any other suitable connection. Alternatively for example, the exemplary elements of components 365 and 370 may be integrated into a single component.

The components of system 300 may be directly connected (e.g., by wire, cable, USB connection, and/or any other suitable electro-mechanical connection) to each other and/or connected via a network (e.g., via Ethernet LAN) that may be similar to the exemplary network disclosed below regarding FIG. 13. System 300 may also include communication components that may be any suitable devices for communicating data between the various components of system 300 either directly or via network communication.

For example, system 300 may include any suitable transceiver devices (e.g., transmitter device and/or receiver device) for transmitting data between components of system 300 and also for receiving data from other components of system 300. System 300 may also include a plurality of computing devices, a plurality of exemplary user interfaces, and/or a plurality of any other components of system 300 that may be in direct communication and/or connected via network. For example, components of system 300 may receive and transmit data as disclosed below regarding exemplary communication techniques of FIG. 13. For example, components of system 300 may wirelessly transmit data by any suitable technique such as, e.g., wirelessly transmitting data via 4G LTE networks (e.g., or any other suitable data transmission technique for example via network communication). Also for example, components of system 300 may transmit data via cable.

Analysis system 320 may include any suitable user interface for receiving input and/or providing output to a user. For example, one or more user interfaces of analysis system 320 may include a touchscreen device (e.g., of a smartphone, a tablet, a smartboard, and/or any suitable computer device), a computer keyboard and monitor (e.g., desktop or laptop), an audio-based device for entering input and/or receiving output via sound, a tactile-based device for entering input and receiving output based on touch or feel, a dedicated user interface designed to work specifically with other components of system 300, and/or any other suitable user interface (e.g., including components and/or configured to work with components described below regarding FIGS. 18 and 19). For example, one or more user interfaces of analysis system 320 may include a touchscreen device of a smartphone or handheld tablet. Also for example, one or more user interfaces of analysis system 320 may include input and/or output devices for a user to enter input and receive output from components of system 300. For example, one or more user interfaces of analysis system 320 may include a display (e.g., a computing device display, a touchscreen display, and/or any other suitable type of display) that may provide processed data, and/or raw data to a user. For example, the exemplary display may include a graphical user interface to facilitate entry of input by a user and/or receive output. For example, a user may utilize one or more user interfaces of analysis system 300 to manipulate raw data results and/or enter parameters to define a set of desired output.

As illustrated in FIGS. 2 and 4-6, training range 325 may be any suitable structural arrangement for containing some or substantially all components of system 300. Training range 325 may for example be a live-fire training range for personnel using firearms with live ammunition such as a firing range or shoot house. Training range 325 may include structural elements (e.g., walls, floors, ceiling) forming one or more rooms that may be partially or substantially entirely enclosed. For example, training range 325 may include a target wall 375 that may serve as a divider between a shooting room 380 and a virtual room 385. The space of virtual room 385 represents a symmetrical reflection of shooting room 380. Target wall 375 may be set against a berm, ballistic wall, and/or bullet trap of training range 325 (e.g., a shoot house, a firing range, or other ballistic structure) to allow live ammunition to pierce through target assembly 315 and be securely captured. Virtual room 385 helps explain the exemplary methods of calculation described below. Virtual room 380 may for example include a back virtual wall 395. Target wall 375 may include an aperture configured to receive and be covered by target assembly 315. Target assembly 315 may thereby be supported within target wall 375 so that target wall 375 serves as a frame supporting target wall 375. As described for example herein, target assembly 315 may have a reflective surface so that a user may see objects reflected on a surface of target assembly 315 as described below. Impact sensors 330 and optical sensors 340 may be supported by target wall 375, target assembly 315, and/or any other suitable component of training range 325. Trigger sensors 335 may be disposed on a wall, ceiling, floor, and/or support of shooting room 380 and/or at any other suitable location of training range 325.

Training range 325 may include a barrier 390 that may be disposed in shooting room 380. Barrier 390 may serve as a safety barrier between occupants of training range 325 during live-fire exercises. For example, barrier 390 may be any suitable structural member including wood, plastic, concrete, and/or any other suitable structural member. Barrier 390 may be a movable, standing barrier that may be moved within shooting room 380 (e.g., or other locations of training range 325) as desired. Barrier 390 may be bulletproof to prevent projectiles such as bullets fired from firearms of users of system 300 from passing through barrier 390 (e.g., projectiles such as bullets fired from firearms may instead become lodged within barrier 390). Some or all walls, ceilings, and/or floors of shooting room 380 (e.g., including target wall 375) may be formed from similar materials as barrier 390. Some or substantially all components of training range 325 may be modular components that may be easily and/or quickly installed and uninstalled in a desired location (e.g., in a warehouse, training facility building, and/or built from scratch in an open area such as a field). For example, target wall 375, target assembly 315, and/or other structural components of training range 325 may be modular components having attachment devices configured to removably attach to each other in a modular fashion. For example, some or all components of training range 325 may be removably attachable to each other to facilitate quick and easy modular installation and uninstallation at multiple locations as desired. For example when uninstalled, some or all components of training range 325 may be compactable (e.g., foldable) so that they may be loaded onto vehicles and moved between installation locations (e.g., hard-site or other permanent locations, tactical locations, and/or any other desired training location). Components of acoustic sensor array 305, optical sensor array 310, target assembly 315, and/or analysis system 320 may be configured to be partially or substantially entirely removable from or retained on modular elements of training range 325 during uninstallation, storage, and/or transport.

Figure 4:
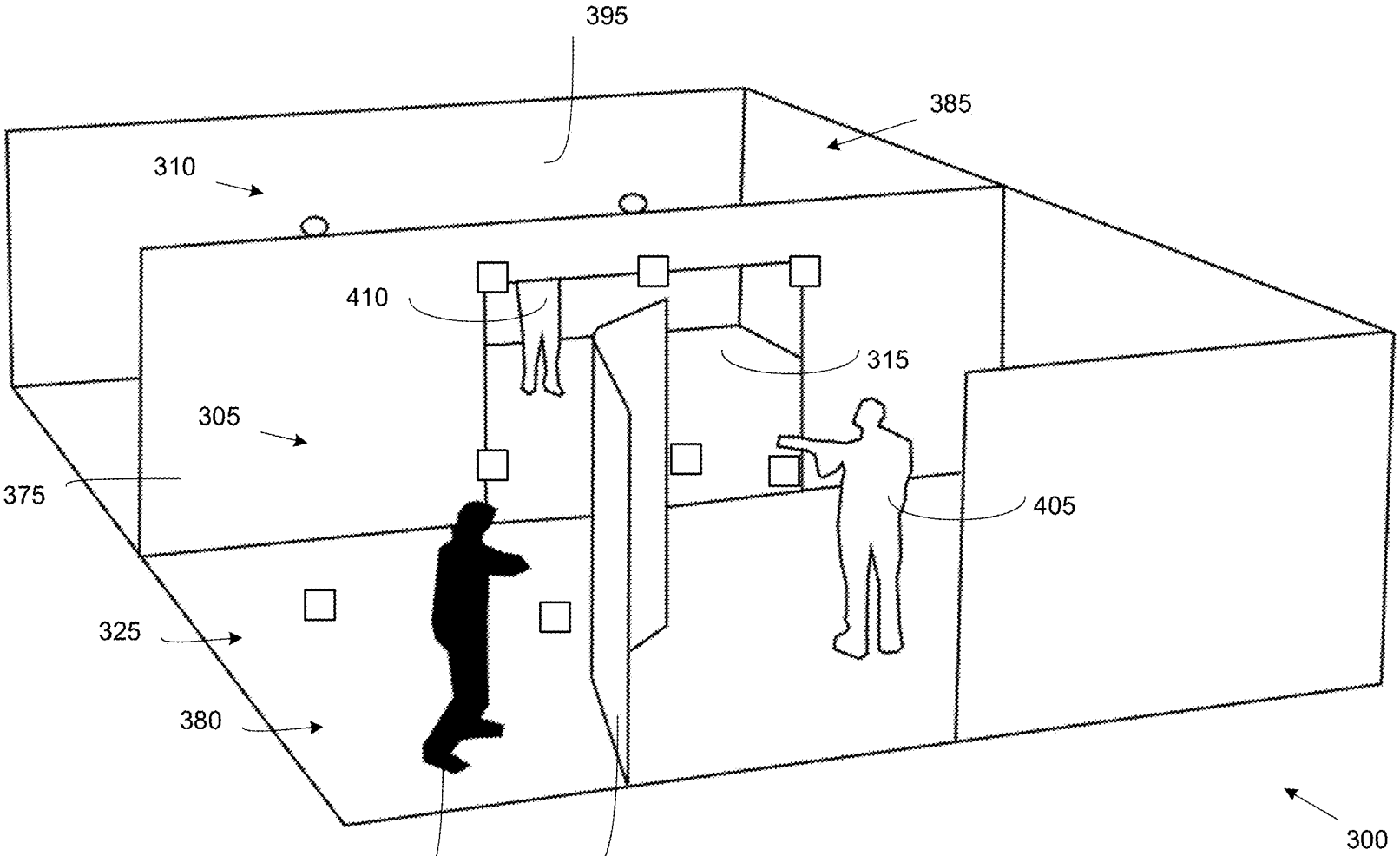
FIG. 4 is a schematic illustration of an exemplary embodiment of the present invention.
Figure 5:
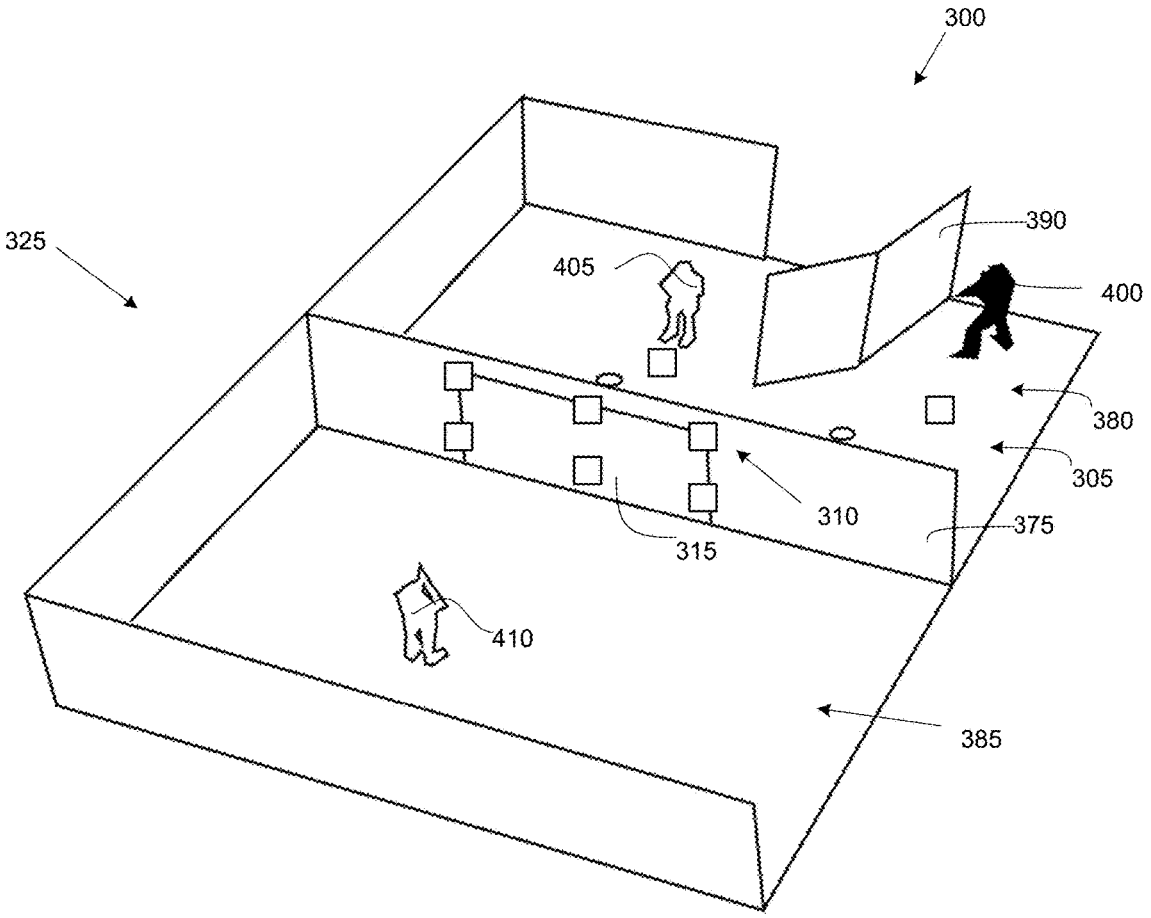
FIG. 5 is a schematic illustration of an exemplary embodiment of the present invention.
Figure 6:
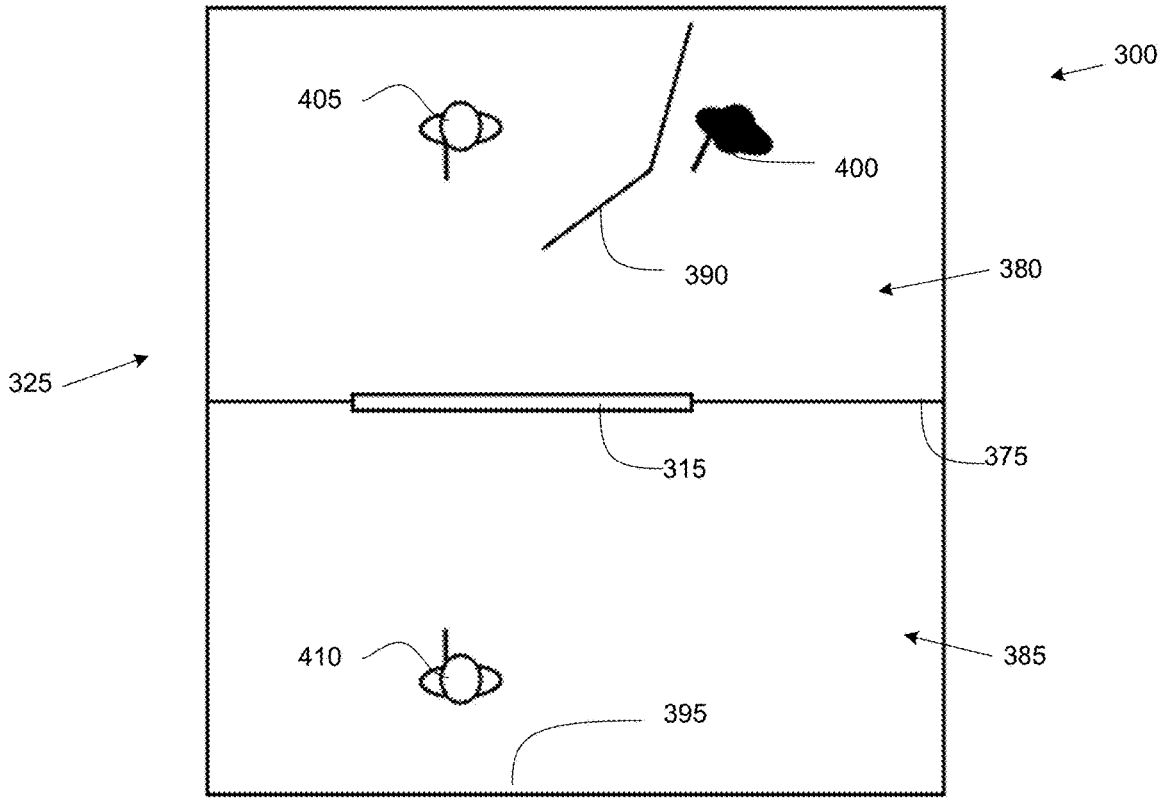
FIG. 6 is a perspective schematic illustration of an exemplary embodiment of the present invention.

As illustrated in FIGS. 4-6 and as described further for example below, a plurality of users may utilize system 300. For example, users may include a shooter 400 and a role-player 405. Shooter 400 and role-player 405 may be located in shooting room 380. Barrier 390 may separate shooter 400 and role-player 405, and may serve as a safety barrier between the users during live-fire exercises. As described further for example below, shooter 400 may be a user carrying a firearm using live ammunition. Role-player 405 may stand in a portion of shooting room 380 so that a target reflection 410 of role-player 405 may be visible to shooter 400 on target assembly 315. For example, the exemplary reflective surface of target assembly 315 described above may be angled so that shooter 400 may see target reflection 410 of role-player 405 on the exemplary reflective surface of target assembly 315. Shooter 400 may thereby be able to fire his or her weapon at target reflection 410. In various exemplary embodiments based on exemplary configurations of target assembly 315 described above, shooter 400 may view features of shooting room 380 on target assembly 315 along with target reflection 410.

Lighting within shooting room 380 may affect the features viewed by shooter 400 on target assembly 315. System 300 may adjust lighting to allow for an optimal operation of optical sensor array 310. System 300 may utilize any suitable techniques to selectively modify lighting and/or room interiors and appearances such as, for example, "Pepper's ghost" optical techniques and any other desired optical effects using reflective surfaces. For example, any desired backdrop or configuration of room features may be made visible to shooter 400 based on any desired scenario (e.g., urban warfare scenario, narcotics seizure scenario, terrorism scenario with room features configured based on known intelligence, hostage release scenario and/or any other desired visual representations). Shooter 400 may thereby view a dynamically moving target reflection 410 on target assembly 315 based on movements of role-player 405. Role-player 405 may thereby interact with shooter 400 via reflected movements of target reflection 410. For example, target assembly 315 may be substantially entirely reflective so that a reflection of shooting room 380 (e.g., including target reflection 410) may be constantly viewed by shooter 400.

Figure 7:
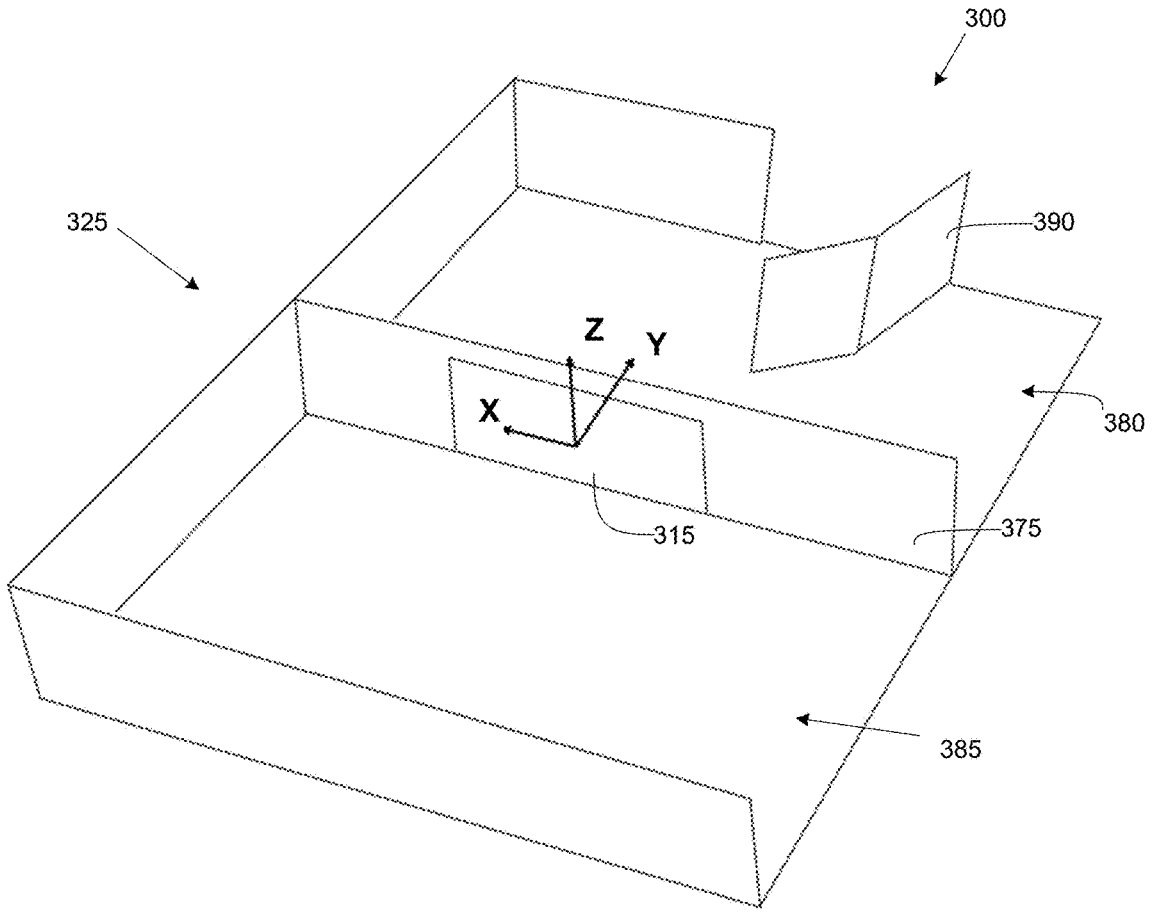
FIG. 7 is a perspective schematic illustration of an exemplary embodiment of the present invention.
Figure 8:
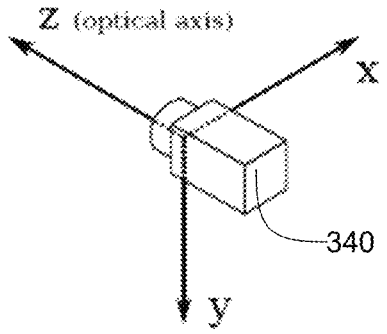
FIG. 8 is a schematic illustration of an exemplary embodiment of the present invention.
Figure 9:
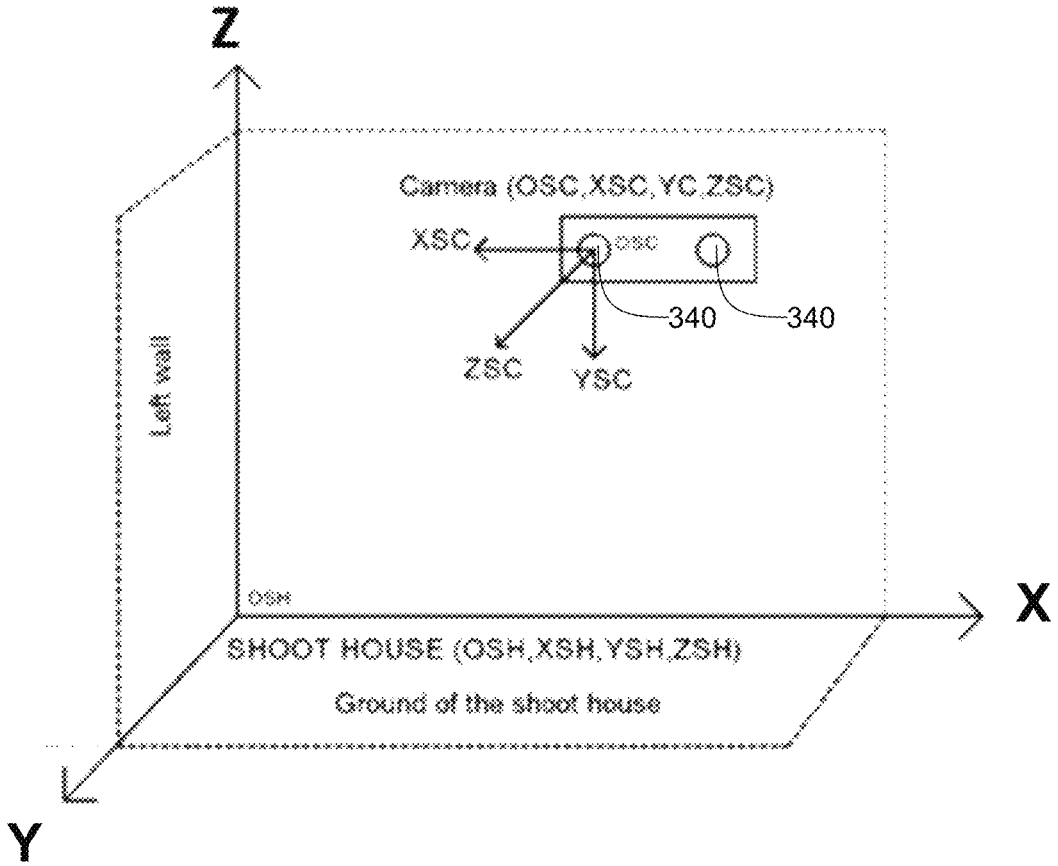
FIG. 9 is a schematic illustration of an exemplary embodiment of the present invention.

As illustrated in FIGS. 7-9 and as described for example herein, any suitable coordinate system may be used by system 300 for determining locations of the various components, users, and/or reflections displayed by system 300. In at least some exemplary embodiments (e.g., and as illustrated in FIG. 7), a cartesian coordinate system may be used to identify coordinate locations of elements of acoustic sensor array 305, optical sensor array 310, target assembly 315, analysis system 320, training range 325, shooter 400 (e.g., location of a tip of a gun barrel of shooter 400 and/or any other desired feature), role-player 405, and/or target reflection 410 (e.g., location of image on a surface of target assembly 315) based on data collected by acoustic sensor array 305, optical sensor array 310, and/or any other suitable source of data available to system 300. For example, to be able to track and measure impact of projectiles on target assembly 315, analysis system 320 may create a three-dimensional referential system that allows the measurement of impact versus position in depth and in space of the reflection viewed by shooter 400 on target assembly 315 (e.g., including target reflection 410). System 300 may perform a calibration based on an establishment of a cartesian referential system that may coordinate the functions (e.g., and location) of acoustic sensor array 305 with the functions (e.g., and location) of optical sensor array 310. For example, system 300 may calibrate optical sensors 340 of optical sensor array 310 to provide coordinate locations (e.g., positions) of shot origination (e.g., based on image data locating a barrel of a firearm of shooter 400) and target positioning (e.g., based on image data locating role-player 405 and/or target reflection 410) in space (e.g., in a space of training range 325). System 300 may thereby locate (e.g., precisely position) target reflection 410 from a view point of shooter 400 in real time. For example, system 300 may locate target reflection 410 on target assembly 315 at the instant of each shot fired by shooter 400, and verify whether or not the impacts registered on target assembly 315 (e.g., by using triangulation and time of arrival) on the impact board (e.g., plate member 360) are on or off target. The target position may then be determined by optical sensors 340 that simultaneously track the barrel (e.g., sight) of shooter 400 and the position of role-player 405 in relation to target assembly 315.

In at least some exemplary embodiments and as illustrated in FIGS. 8 and 9, system 300 may perform two calibrations of optical sensor array 310. As illustrated in FIG. 8, system 300 may perform stereoscopic calibration of one or more optical sensors 340 in a camera coordinate system (e.g., a coordinate system including OSC, XSC, YSC, ZSC). For example, the calibration may be between two sensors 340. This calibration may be an initial calibration that is independent from the calibration described below. System 300 may perform this calibration as a first calibration.

As illustrated in FIG. 9. system 300 may also perform a calibration in the coordinate system of training range 325 (e.g., a coordinate system including OSH, XSH, YSH, ZSH). System 300 may perform this calibration as a second calibration. This exemplary calibration may facilitate the functionality of system 300 as a data collection tool. This exemplary calibration may calibrate one or more optical sensors 340 (e.g., two stereoscopic camera systems) in an xyz coordinate system in accordance with the cartesian referential system of training range 325 as illustrated for example in FIG. 9. The calibration may facilitate real time shot placement and accuracy control (e.g., including synchronization of an operation of acoustic sensor array 305 and optical sensor array 310) relative to target reflection 410 from a point of view of shooter 400.

In at least some exemplary embodiments, system 300 may include a target assembly (e.g., target assembly 315) having a reflective surface (e.g., surface of reflective layer 345), a plurality of acoustic sensors (e.g., impact sensors 330) disposed at the target assembly, and at least one optical sensor (e.g., optical sensor 340). The target assembly may include sound-absorbing material. The at least one optical sensor may be configured to image a plurality of users (e.g., shooter 400 and role-player 405) of the system. The target assembly may include a reflective layer (e.g., reflective layer 345) and an acoustic layer (e.g., acoustic layer 350). The reflective layer may be a metalized polyester film or any other type of metalized coated plastic film that provides sufficient clarity of reflection. The acoustic layer may include the sound-absorbing material (e.g., absorbing layer 355) and an impact plate (e.g., plate member 360). The at least one optical sensor may include a plurality of stereoscopic cameras. The plurality of acoustic sensors may include a plurality of microphones. The plurality of microphones may be configured to locate a bullet impact point on the target assembly based on time of arrival extraction and/or triangulation computing. The system may further include an additional plurality of acoustic sensors (e.g., trigger sensors 335) disposed at a location facing the reflective surface of the target assembly. The additional plurality of acoustic sensors may include a plurality of microphones configured to determine a time at which a firearm is fired and trigger a start of data collection by the plurality of acoustic sensors and the at least one optical sensor. The at least one optical sensor may be configured to collect three-dimensional image data of a barrel of a firearm of the plurality of users. The at least one optical sensor may be configured to collect image data of the plurality of users.

In at least some exemplary embodiments, system 300 may include an impact shot tracking module (e.g., analysis system 320), comprising computer-executable code stored in non-volatile memory, a processor, an acoustic sensor array (e.g., acoustic sensor array 305), an optical sensor array (e.g., optical sensor array 310), and a target assembly (e.g., target assembly 315). The impact shot tracking module, the processor, the acoustic sensor array, the optical sensor array, and the target assembly may be configured to reflect an image (e.g., target reflection 410) of a first user (e.g., role-player 405) on the target assembly, the reflected image of the first user being visible to a second user (e.g., shooter 400) at a second location, sense a time at which a firearm of the second user is fired at the target assembly, sense a projectile impact location point on the target assembly of a projectile fired from the firearm of the second user, and determine a location of the reflected image (e.g., target reflection 410) of the first user on a reflective surface of the target assembly. The system may also include using the optical sensor array to sense a location of a barrel of the firearm. The acoustic sensor array may sense the time at which the firearm is fired and the projectile impact location point. Determining the location of the reflected image of the first user on the reflective surface of the target assembly may be based on using the optical sensor array to sense a location of the first user.

The exemplary disclosed apparatus, system, and method may be used in any suitable application for firearms training. For example, the exemplary disclosed apparatus, system, and method may be used in any suitable application for live-fire training of firearms and/or professional training of personnel. The exemplary disclosed apparatus, system, and method may be used in any suitable application for tactical training of military, police, and security force personnel in using their respective service weapons. The exemplary disclosed apparatus, system, and method may also be used to train firearms users in general.

Figure 10:
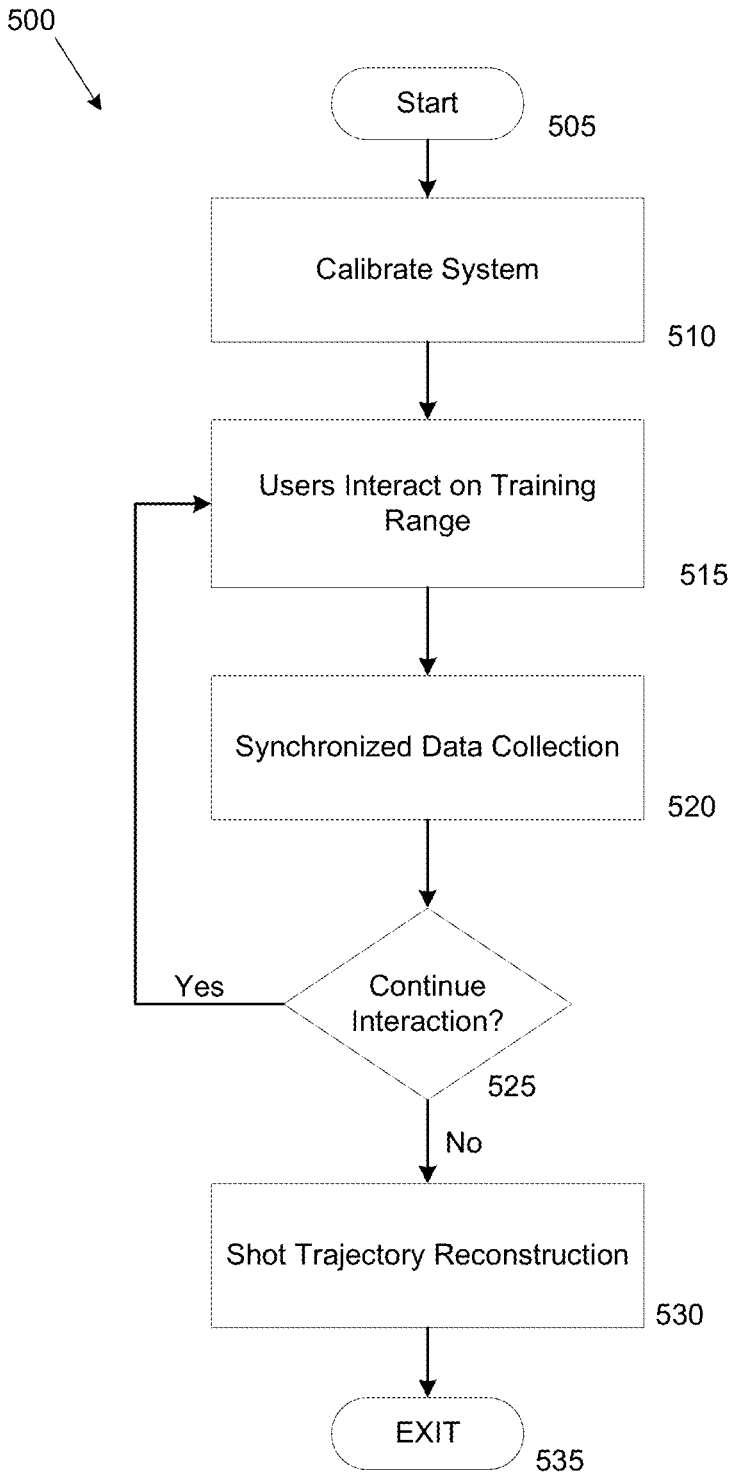
FIG. 10 is a flowchart showing an exemplary process of the present invention.

An exemplary operation of the exemplary disclosed apparatus, system, and method will now be described. For example, FIG. 10 illustrates an exemplary process 500. Process 500 begins at step 505. System 300 may be installed at step 505 as illustrated for example in FIGS. 1 and 2. At step 510, system 300 may calibrate optical sensor array 310 as illustrated in FIGS. 8 and 9 and as described for example above.

At step 515, shooter 400 and role-player 405 may interact on training range 325 to for example conduct a live-fire training exercise using real firearms and live ammunition. As illustrated for example in FIGS. 4-6, shooter 400 and role-player 405 may both be located in shooting room 380 and separated by barrier 390. Barrier 390 may block a direct line-of-sight between shooter 400 and role-player 405. As described in at least some of the exemplary configurations above, shooter 400 may view features of shooting room 380 reflected on target assembly 315 (e.g., including target reflection 410). As disclosed for example above, any desired backdrop or configuration of room features may be visible to shooter 400 based on a desired scenario. Role-player 405 may make any desired movements and actions based on any desired scenario or exercise conditions, which may be mirrored by target assembly 315 and be visible to shooter 400 via target reflection 410. Based on any desired scenario, shooter 400 may fire a projectile such as a bullet using his or her firearm at target reflection 410. The bullet may impact target assembly 315, pass through reflective layer 345 and acoustic layer 350, and then be embedded in a berm, ballistic wall, and/or bullet trap of training range 325 as described above.

At step 520, system 300 may collect data of the movements, interaction, and/or firearm usage of step 515. Step 520 may occur concurrently with step 515, with data being collected in real time or near real time by system 300. One or more trigger sensors 335 may open a data gathering window for data collection by acoustic sensor array 305 and/or optical sensor array 310 as described above. One or more impact sensors 330 may detect a location at which a projectile such as a bullet fired by a firearm may strike target assembly 315. One or more optical sensors 340 may determine a position of a barrel of a firearm used by shooter 400. System 300 may also determine a location of target reflection 410 from a point of view of shooter 400 (e.g., based on one or more optical sensors 340 sensing a location of role-player 405, which may be used to determine a location of target reflection 410). Analysis system 320 may synchronize an operation of acoustic sensor array 305 and optical sensor array 310 during data collection so that data sensed by each sensor is synchronized (e.g., synchronized with respect to a time of occurrence or measurement) with data sensed by other sensors. Based on the calibration of step 510, location data sensed by each sensor may be calibrated with respect to location (e.g., location data may be referenced to the same coordinate system) with data sensed by other sensors.

At step 525, system 300 (e.g., automatically or based on input from an operator of system 300) may determine whether or not interaction by users with system 300 will continue. If interaction continues, system 300 may return to steps 515 and 520. If interaction is complete (e.g., a firearm training exercise is complete), system 300 may proceed to step 530 to determine a shot trajectory reconstruction. It is also contemplated that steps 515, 520, and 530 may occur concurrently and that system 300 may collect data and determine a shot trajectory reconstruction in real time or near real time as users interact with system 300.

Figure 11:
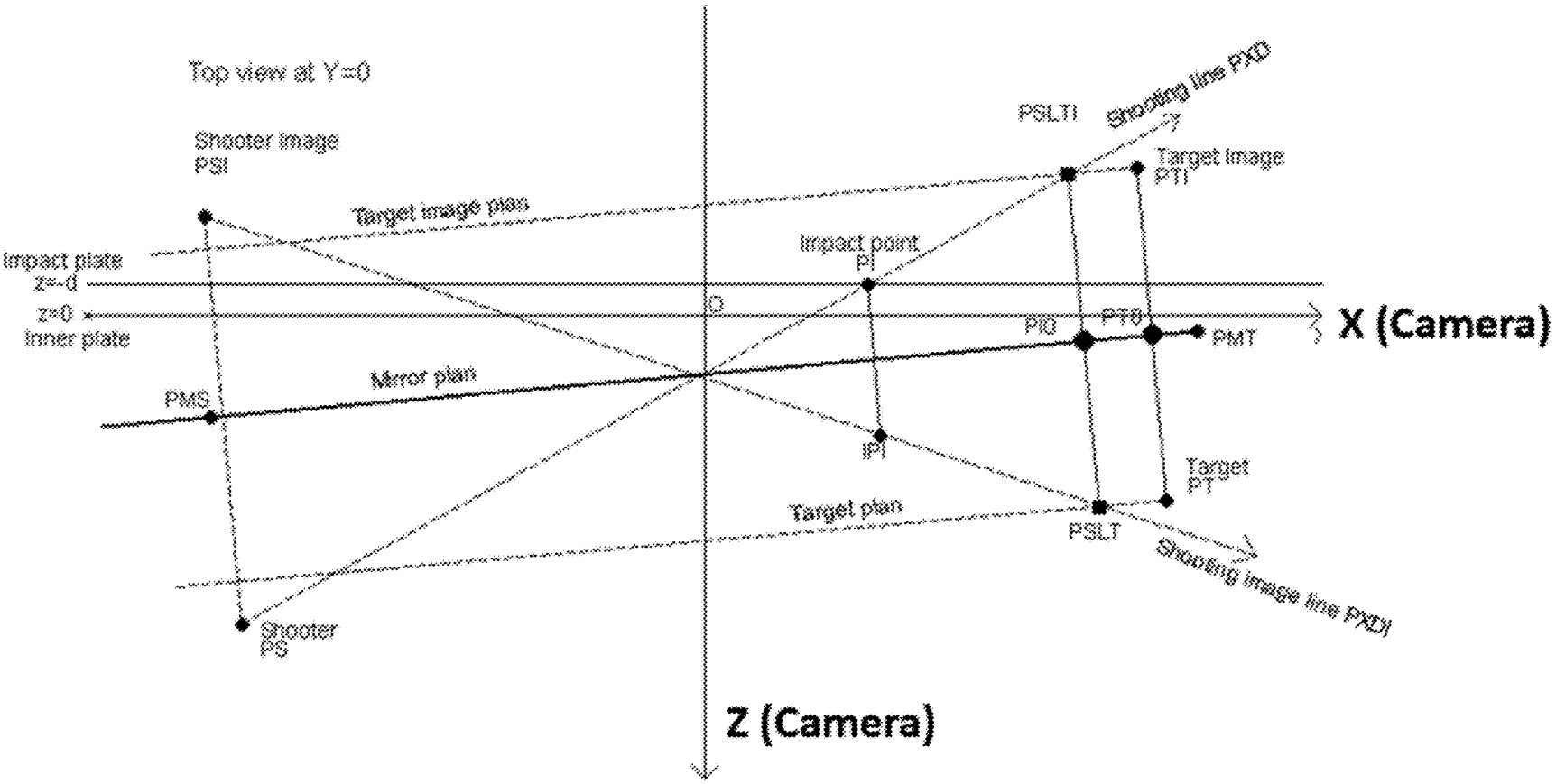
FIG. 11 is a schematic illustration of an exemplary embodiment of the present invention.

At step 530, system 300 may perform a shot trajectory reconstruction as illustrated for example in FIG. 11. FIG. 11 illustrates an exemplary top view of a portion of training range 325 that may be imaged by one or more optical sensors 340. FIG. 11 illustrates an exemplary geometrical analysis and calculation that may be performed by analysis system 320 using data collected by acoustic sensor array 305 and optical sensor array 310 during step 520. FIG. 11 illustrates an exemplary top view picture taken from optical sensors 340 showing the method of geometrical calculation leading to the scene reconstruction based on the data collected by acoustic sensor array 305 and optical sensor array 310 and the calibration process relative to the space in front of the reflective plane of target assembly 315. As illustrated in FIG. 11, the collected data may be visualized relative to a mirror plane (e.g., of reflective layer 345 facing shooting room 380, which may include points "PMS" and "PMT"), an "inner plate" (e.g., absorbing layer 355), and an "impact plate" (e.g., plate member 360). Using the collected data, system 300 may determine a location of a target image plane (e.g., including a determined point of target reflection 410, "PTI") and a location of a target plane (e.g., including a determined point of role-player 405, "Target PT") that may be parallel to the mirror plane. System 300 may also determine a shooting line (e.g., "PXD") beginning at a firearm of shooter 400 (e.g., "Shooter PS") and crossing (e.g., impacting) "impact plate" (e.g., plate member 360) at an impact point (e.g., "PI") and crossing the target image plane (e.g., at "PSLTI"). System 300 may also determine a shooting image line (e.g., "PXDI") beginning at a mirror image firearm of shooter 400 (e.g., "Shooter Image PSI") and including an image impact point (e.g., "IPI") and also crossing the target plane (e.g., at "PSLT"). System 300 may also determine a point "PI0" that may be at an intersection of a line formed between points "PSLTI" and "PSLT" and the mirror plane, as well as a point "PT0" that may be at an intersection of a line formed between points "PTI" and "PT" and the mirror plane. The exemplary points described above may be determined directly or derived from from sensed data collected by acoustic sensor array 305 and optical sensor array 310 during step 520. System 300 (e.g., analysis system 320) may thereby determine whether or not each shot fired by shooter 400 during a training exercise may hit or miss target reflection 410 in real time during the exercise. A performance of shooter 400 shooting live rounds of ammunition at a dynamic and interactive target reflection 410 may thereby be quantitatively analyzed and evaluated by system 300 and precise feedback provided to shooter 400. For example in the exemplary illustration of FIG. 11, shooter 400 may be informed that the exemplary fired shot was off to the left of the target (e.g., point "PSLTI" is to the left of point "PTI"). For example, when a location of "PSLT1" is equal to (e.g., or within a predetermined distance from) a location of "PTI," then the shot fired by shooter 400 may be evaluated as striking the intended target (e.g., target reflection 410). System 300 may exit process 500 at step 535.

In at least some exemplary embodiments, the exemplary disclosed method may include using a reflective surface of a target assembly (e.g., target assembly 315) to reflect an image of a first user (e.g., role-player 405) at a first location to be visible on the reflective surface to a second user (e.g., shooter 400) at a second location. The method may also include acoustically sensing (e.g., sensing using acoustic sensors) a bullet impact location point on the target assembly of a bullet fired from a firearm of the second user and optically sensing (e.g., sensing using optical sensors) a location of the first user and the second user. The method may also include acoustically sensing a time at which the firearm of the second user is fired and optically sensing a location of a barrel of the firearm. Acoustically sensing and optically sensing may be synchronized. The method may also include disposing a line-of-sight barrier (e.g., barrier 390) between the first user at the first location and the second user at the second location.

It is contemplated that system 300 may provide for an interactive exercise in which role-player 405 may also fire (e.g., fire live-fire ammunition) at a target reflection of shooter 400 in a manner similar to the exemplary techniques described above. For example, system 300 may simultaneously evaluate shots fired by role-player 405 at a target reflection of shooter 400 while shooter 400 is firing at target reflection 410 of role-player 405 (e.g., role-player 405 may become another shooter firing back at a target reflection of shooter 400). In this exemplary embodiment, system 300 may provide for a realistic force-on-force simulation in which each shooter attempts to hit the other shooter first, as in a realistic confrontational situation often faced by military and law enforcement personnel. Additional sensors and computing components similar to the exemplary elements described above may be added to system 300 to facilitate this exemplary embodiment. Additions and adjustments may also be made to training range 325 to facilitate this exemplary embodiment.

In at least some exemplary embodiments, system 300 may track the impacts of shots fired from a weapon (e.g., pistol, rifle, and/or any other suitable firearm) in real time to be able to make the shot sequence (e.g., towards a moving/live reflection) analyzable and valuable from a professional training point of view. For example, training range 325 may be calibrated from target assembly 315 in a cartesian referential by system 300.

In at least some exemplary embodiments, system 300 may provide a scenario-based firearms training using naturally moving targets in a secure and realistic way. The targets (e.g., target reflection 410) may be lively and dynamic moving targets that allow for scenario-based shot sequences, which may bring target training to the level of professional engagement, use of force engagement, and high-fidelity realism. For example, system 300 may provide training of an interactive nature that uses high accuracy tracking capability. System 300 may allow for an individual and focused experience for a user such as a student, while permitting the capture and measurement of shooting performance in a simple, modular, and cost-effective way. System 300 may analyze and process large amounts of training data related to firearms training. System 300 may also provide analysis of shot grouping and precision of impact to measure proficiency, while also providing opportunities to train with realistic moving targets, encounter confrontational emotional situations, and practice decision making regarding the use of force. The exemplary method may place and track impacts of projectiles at a short distance on a large surface (e.g., target assembly 315) involving differing calibers and bullet velocities, in a challenging acoustic environment with high precision.

In at least some exemplary embodiments, system 300 may provide video feed of a user such as a trainee (e.g., shooter 400) from smart security glasses (e.g., worn by shooter 400 and/or role-player 405) to provide additional data for analysis regarding performance. System 300 may also include personal devices (e.g., physiological measurement devices such as bracelets) to provide additional data for the analysis of a given shot sequence (e.g., including heart rate, stress indicators, and/or any other desired biometric indicators). Also for example, fixed cameras may be linked to system 300 to record position and movement of shooter 400 and also equipment of shooter 400 for further analysis. Such a data feed may be used by trainers for performance analysis.

Figure 12:
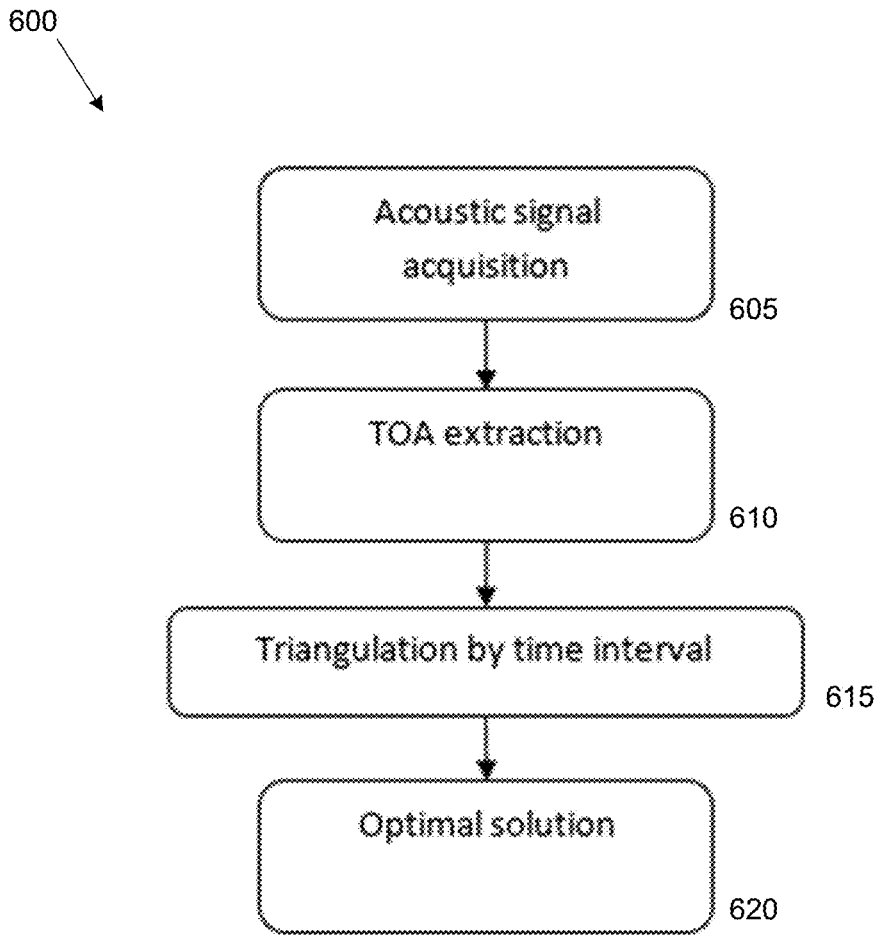
FIG. 12 is a flowchart showing an exemplary process of the present invention.

FIG. 12 illustrates process 600, another exemplary process of the present invention. Process 600 may be a method for locating a projectile (e.g., bullet) impact point on target assembly 315. For example, process 600 may be a time of arrival (TOA) extraction and triangulation by time interval method.

At step 605, system 300 may perform an acoustic signal acquisition step. System 300 may digitize signals from a plurality of impact sensors 330. For example, system 300 may digitize signals from six microphones.

At step 610, system 300 may perform a time of arrival (TOA) step. System 300 may determine a signal time band for a triangulation calculation.

At step 615, system 300 may perform a "triangulation by time interval step. System 300 may carry out a triangulation calculation to determine (e.g., determine an evaluation) of a position of an impact point of the projectile.

At step 620, system 300 may determine an optimal solution for process 600. For example, system 300 may determine an optimal solution for an impact point on target assembly 315 with respect to overall coherence of the plurality of impact sensors 330 (e.g., a plurality of microphones such as six microphones).

Figure 13A:
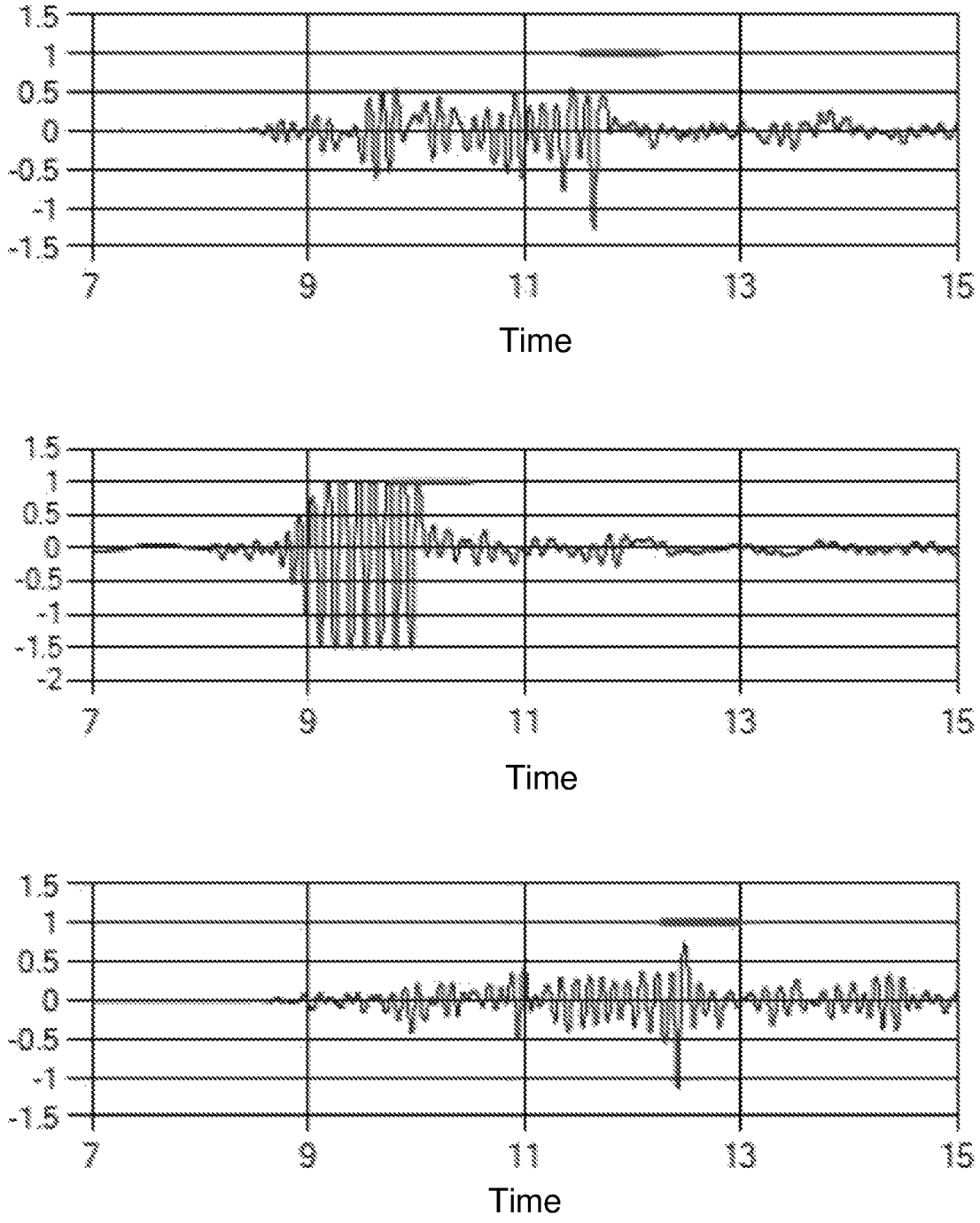
FIG. 13A is an illustration of exemplary noise generation.
Figure 13B:
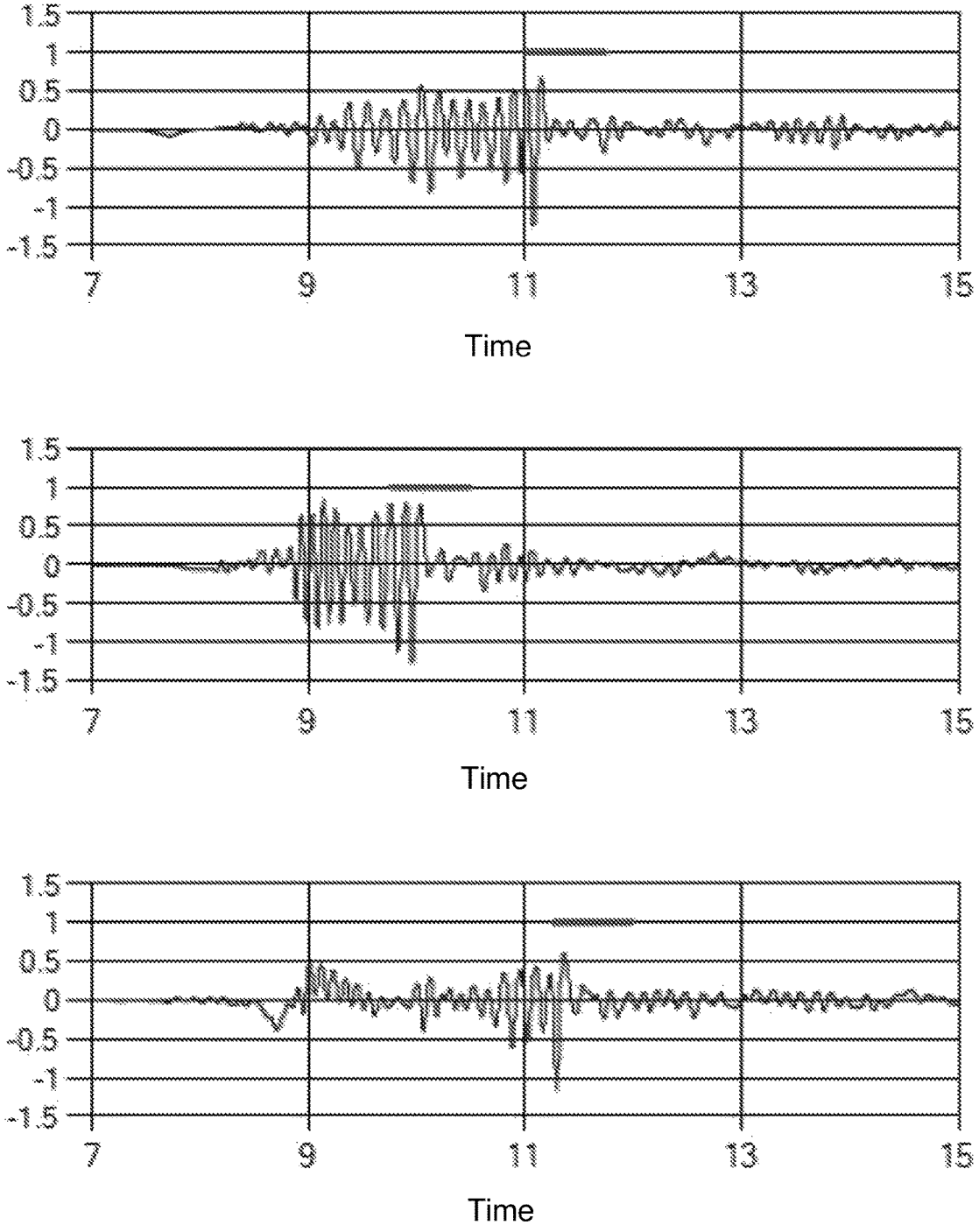
FIG. 13B is an illustration of exemplary noise generation.

As illustrated in the examples of FIGS. 13A and 13B, noise generated by an impact of a firearm projectile on a plate made of rigid material (e.g., plate member 360) may be relatively complex. For example, when a shooter 400 fires near target assembly 315 (e.g., a few meters from target assembly 315), the noise of the impact on target assembly 315 may be mixed with the sound of detonation (e.g., of the firearm firing) and the sound of a shockwave of the projectile (e.g., a supersonic shot). For example, impact noise (e.g., noise of a projectile striking plate member 360 of target assembly 315) may be characterized by a frequency signal sequence in a bandwidth of between about 5 kHz and about 10 kHz.

Figure 14:
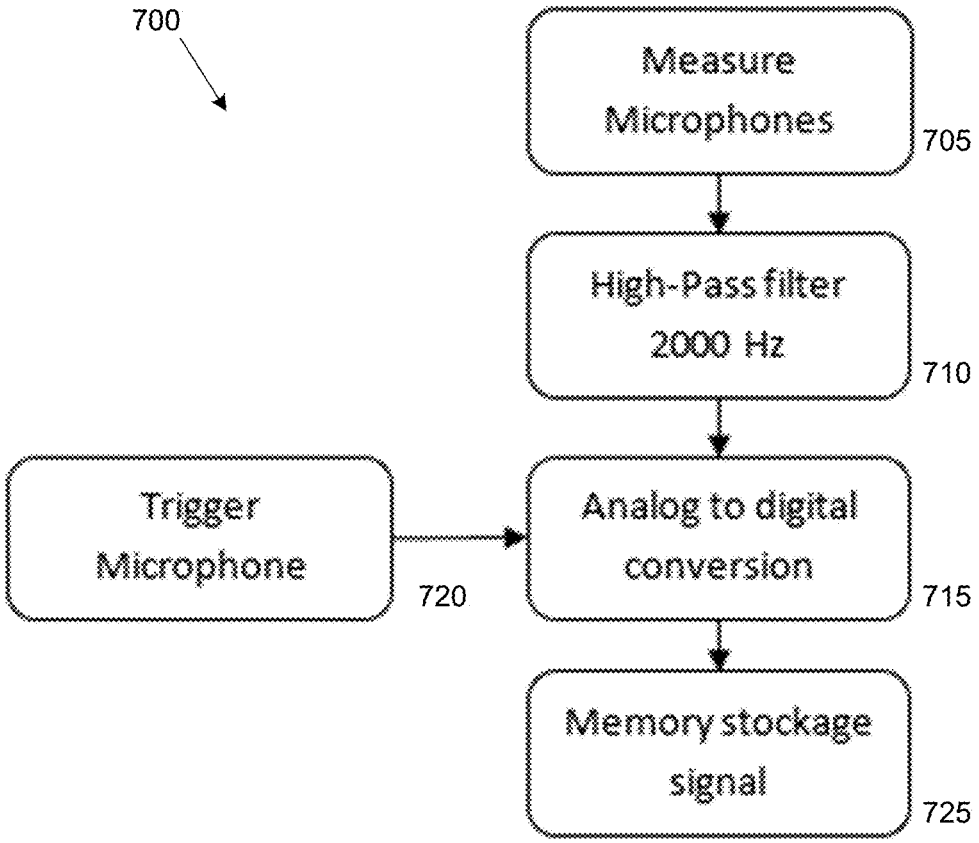
FIG. 14 is a flowchart showing an exemplary process of the present invention.

FIG. 14 illustrates process 700, another exemplary process of the present invention. For example, process 700 may be a signal acquisition process.

At step 705, system 300 may measure acoustic signals using impact sensors 330. For example, system 300 may use a plurality of microphones (e.g., six microphones).

At step 710, system 300 may utilize a high-pass filter to reduce a sound of a detonation of a firearm. For example, system 300 may utilize a high-pass filter at 2000 Hz to reduce the sound of detonation of the firearm.

At step 715 and step 720, system 300 may trigger an analog digital conversion by using trigger sensor 335 to detect the start of a shot from a firearm. For example during steps 715 and 720, the sampling frequency may be about 150 kHz or any other suitable frequency and the duration of the acquisition window may be about 20 ms or any other suitable duration.

At step 725, the digitized signals may be stored for subsequent processing. For example, the digitized signals may be stored using a high capacity RAM.

Figure 15:
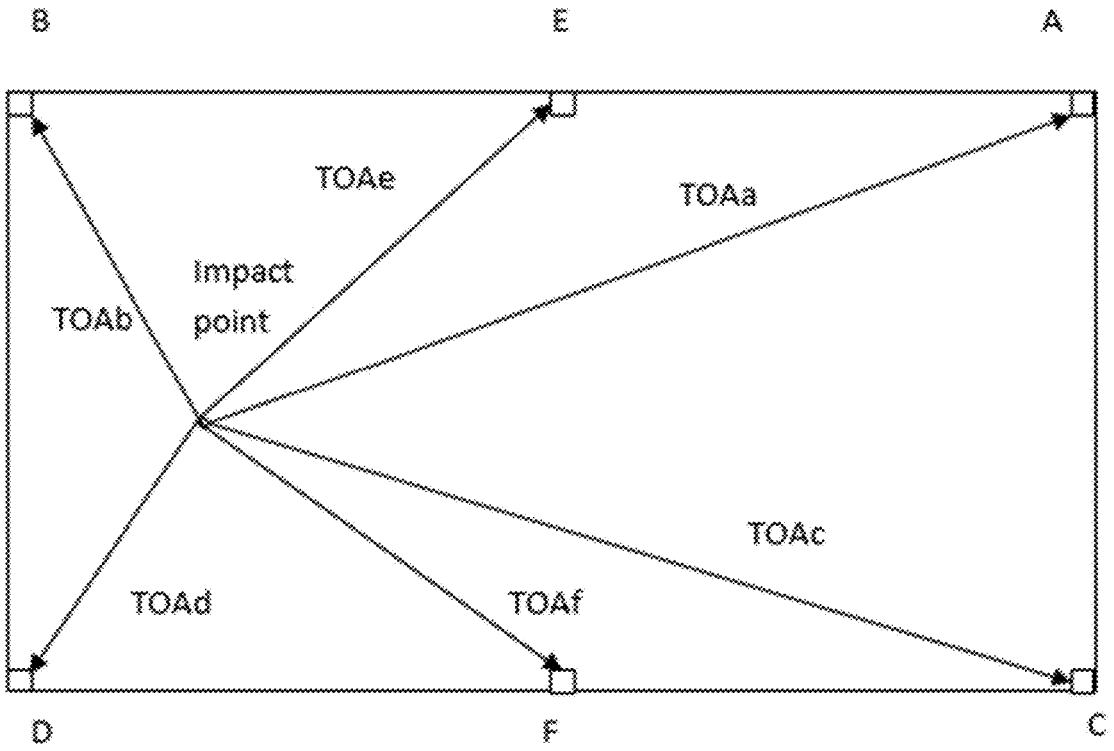
FIG. 15 is a schematic illustration of an exemplary method of the present invention.
Figure 16:
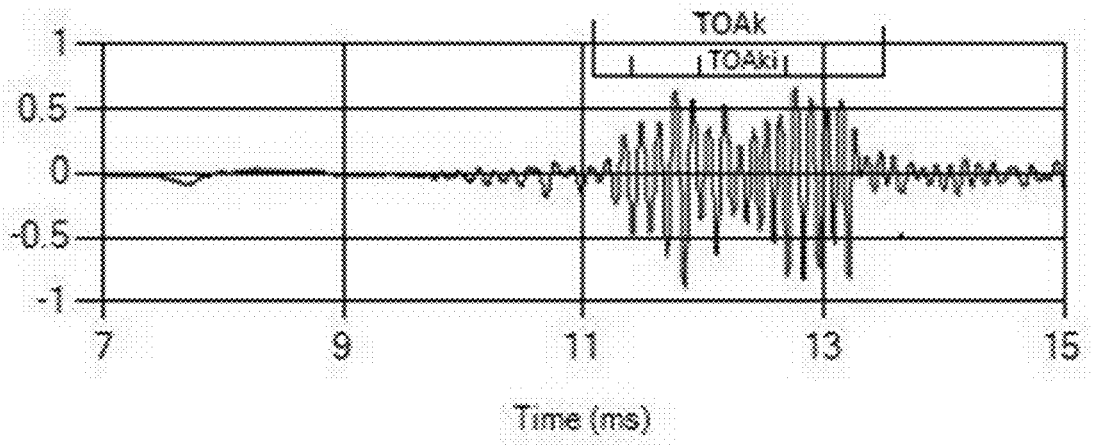
FIG. 16 is a schematic illustration of an exemplary signal band of the present invention.

In at least some exemplary embodiments and as illustrated in FIG. 15, system 300 may calculate the point of impact of a projectile on target assembly 315 by triangulation, based on the time of arrival (TOA). The TOA may correspond to a travel time of the impact noise between the instant or moment of the impact and the instant or moment when the impact noise arrives at acoustic sensor array 305 (e.g., arrives at impact sensors 330 such as microphone). As illustrated in FIG. 15, a plurality of TOAs (e.g., six TOAs such as TOAa, TOAb, TOAc, TOAd, TOAe, and TOAf) may be determined based on the signals from impact sensors 330. For example as opposed to precisely determining these TOAs in view of the complexity of the impact noise signal, a signal band (e.g., TOAk as illustrated in FIG. 16) in which the TOA is located may be determined (e.g., by an energy level criterion). This exemplary signal band (e.g., TOAk), in which the TOA is located, may be divided into time intervals. For example as illustrated in FIG. 16, each exemplary interval may be noted as TOAki (with "k" indicating a given impact sensor 330 and "i" indicating the time interval). System 300 may perform triangulation calculations for each time interval.

Figure 17:
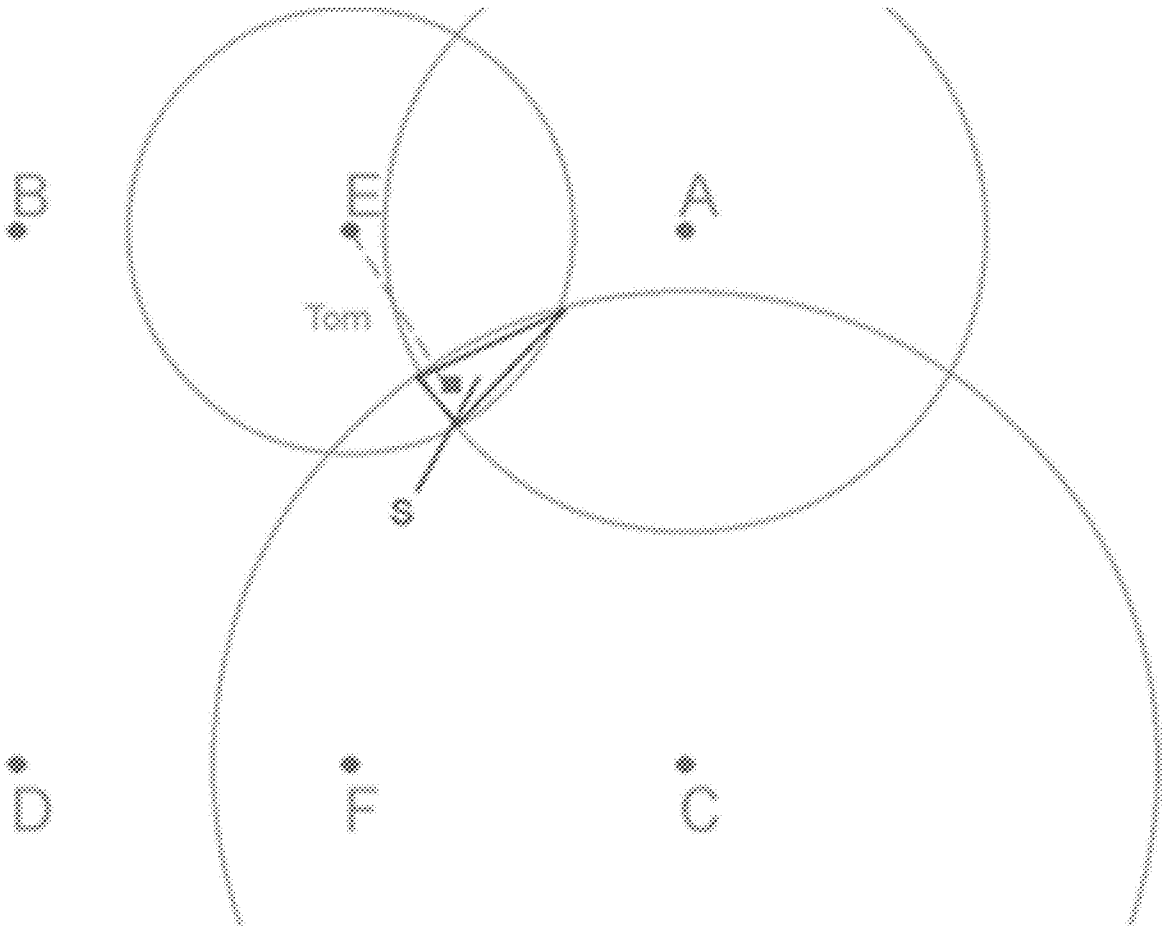
FIG. 17 is a schematic illustration of an exemplary embodiment of the present invention.

System 300 may use any suitable technique for acoustic triangulation. For example, system 300 may use a plurality of impact sensors 330 such as six impact sensors 330 or any other desired number of impact sensors 330. For example, system 300 may use three impact sensors 330. For example as illustrated in FIG. 17, system 300 may use a triangulation algorithm based on a search of time ("Tom") between an instant or moment of an impact of a projectile on plate member 360 and the arrival of this impact noise on impact sensor 330 that is closest to the location of projectile impact. This algorithm of calculation of the search of time ("Tom") may proceed by iteration until system 300 determines the "Tom" that minimizes the area of intersection "S" as illustrated, e.g., in FIG. 17. For example, this algorithm may be implemented for substantially all possible triplets of the plurality of impact sensors 330 (e.g., six impact sensors 330 represented as A, B, C, D, E, and F in FIG. 17) and for all "TOAki" intervals. These calculations may yield a large number of solutions, the best (optimal solutions) of which are determined by system 300. For example, system 300 may use a minimum standard deviation criterion to determine the optimal solution. The position accuracy of the point of impact may be in the range of between about 5 cm (centimeters) and about 10 cm for target assembly 315 that may be about 3 m (meters) wide and about 2 m high. Also, the position accuracy may depend on the caliber of the firearm shooting the projectile.

The exemplary disclosed apparatus, system, and method may provide an efficient and easy-to-implement technique for providing ultra-realistic training to a user (e.g., trainee) that may involve no additional equipment or gear to be used by the user. Also, the exemplary disclosed apparatus, system, and method may provide realistic live-fire training for a user, who may use his or her own service weapon and live ammunition in the training. The exemplary disclosed apparatus, system, and method may provide for high precision of shot sequence analyses for complex engagement scenarios, which may allow for precise evaluation of a user's accuracy and performance in negotiating the tasks of a training exercise. The exemplary disclosed apparatus, system, and method may also provide for versatile use of role-playing actors (e.g., posing as a threat) and backdrops to add realism to the user's training experience. The exemplary disclosed apparatus, system, and method may provide a modular system that may be quickly and efficiently installed in a variety of locations.

Figure 18:
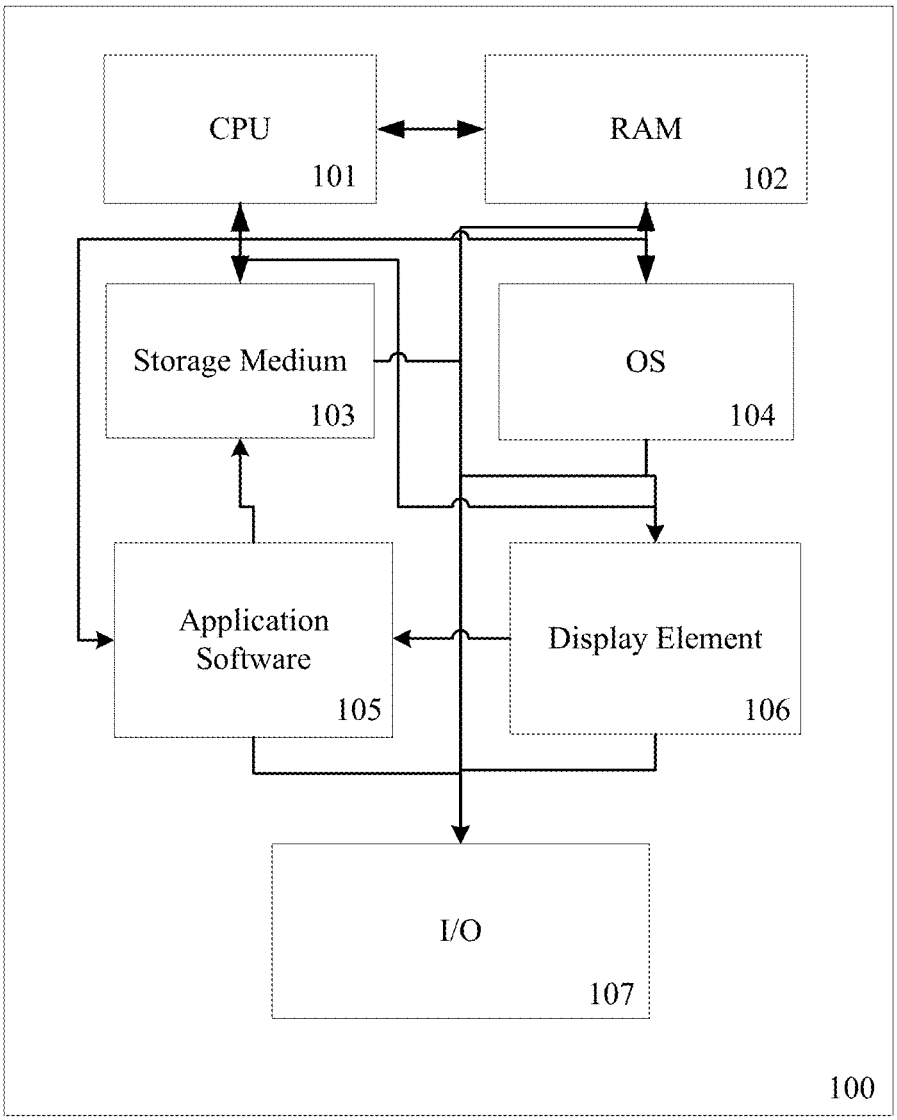
FIG. 18 is a schematic illustration of an exemplary computing device, in accordance with at least some exemplary embodiments of the present disclosure.

An illustrative representation of a computing device appropriate for use with embodiments of the system of the present disclosure is shown in FIG. 18. The computing device 100 can generally be comprised of a Central Processing Unit (CPU, 101), optional further processing units including a graphics processing unit (GPU), a Random Access Memory (RAM, 102), a mother board 103, or alternatively/additionally a storage medium (e.g., hard disk drive, solid state drive, flash memory, cloud storage), an operating system (OS, 104), one or more application software 105, a display element 106, and one or more input/output devices/means 107, including one or more communication interfaces (e.g., RS232, Ethernet, Wifi, Bluetooth, USB). Useful examples include, but are not limited to, personal computers, smart phones, laptops, mobile computing devices, tablet PCs, touch boards, and servers. Multiple computing devices can be operably linked to form a computer network in a manner as to distribute and share one or more resources, such as clustered computing devices and server banks/farms.

Various examples of such general-purpose multi-unit computer networks suitable for embodiments of the disclosure, their typical configuration and many standardized communication links are well known to one skilled in the art, as explained in more detail and illustrated by FIG. 19, which is discussed herein-below.

According to an exemplary embodiment of the present disclosure, data may be transferred to the system, stored by the system and/or transferred by the system to users of the system across local area networks (LANs) (e.g., office networks, home networks) or wide area networks (WANs) (e.g., the Internet). In accordance with the previous embodiment, the system may be comprised of numerous servers communicatively connected across one or more LANs and/or WANs. One of ordinary skill in the art would appreciate that there are numerous manners in which the system could be configured and embodiments of the present disclosure are contemplated for use with any configuration.

In general, the system and methods provided herein may be employed by a user of a computing device whether connected to a network or not. Similarly, some steps of the methods provided herein may be performed by components and modules of the system whether connected or not. While such components/modules are offline, and the data they generated will then be transmitted to the relevant other parts of the system once the offline component/module comes again online with the rest of the network (or a relevant part thereof). According to an embodiment of the present disclosure, some of the applications of the present disclosure may not be accessible when not connected to a network, however a user or a module/component of the system itself may be able to compose data offline from the remainder of the system that will be consumed by the system or its other components when the user/offline system component or module is later connected to the system network.

Figure 19:
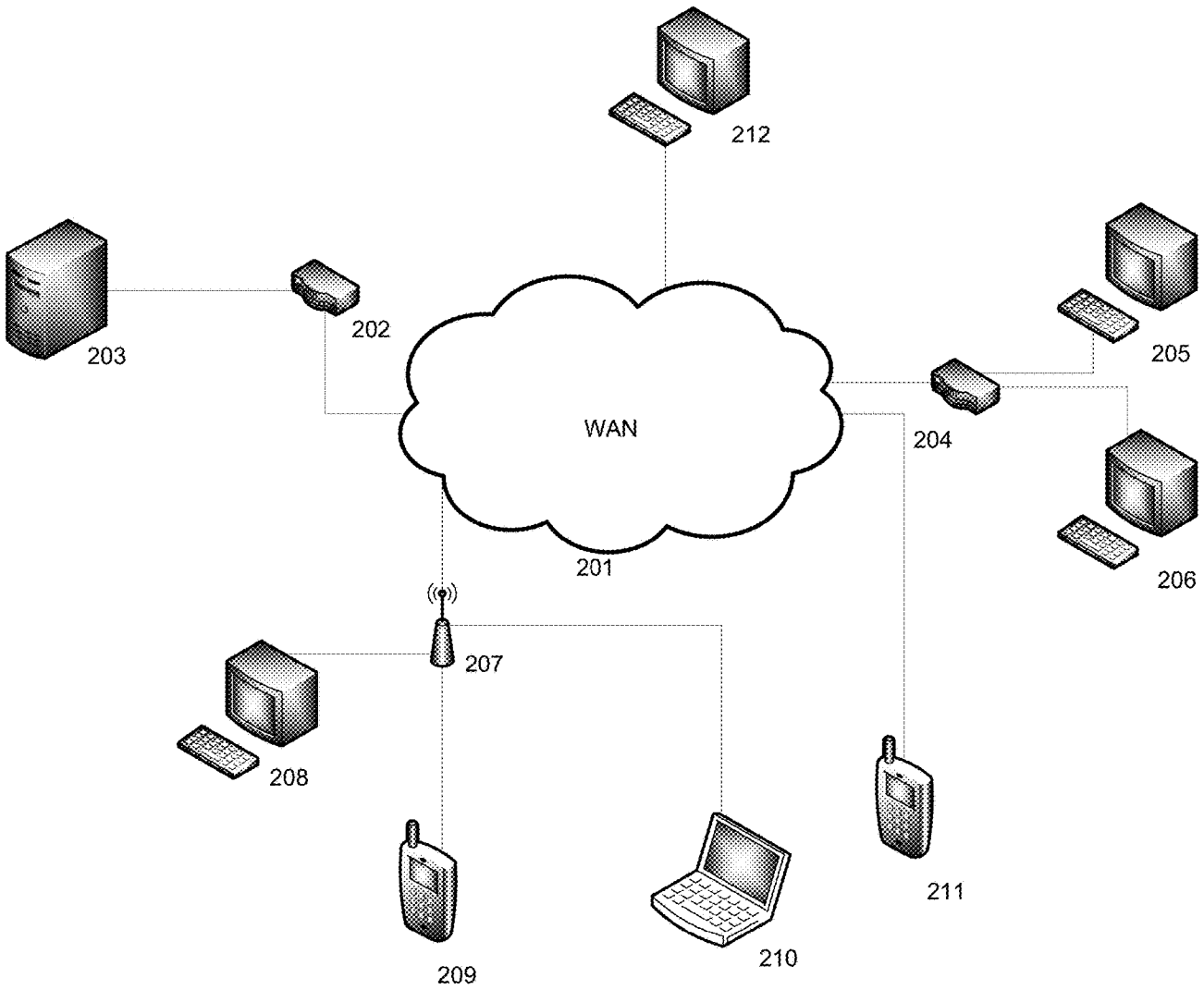
FIG. 19 is a schematic illustration of an exemplary network, in accordance with at least some exemplary embodiments of the present disclosure.

Referring to FIG. 19, a schematic overview of a system in accordance with an embodiment of the present disclosure is shown. The system is comprised of one or more application servers 203 for electronically storing information used by the system. Applications in the server 203 may retrieve and manipulate information in storage devices and exchange information through a WAN 201 (e.g., the Internet). Applications in server 203 may also be used to manipulate information stored remotely and process and analyze data stored remotely across a WAN 201 (e.g., the Internet).

According to an exemplary embodiment, as shown in FIG. 19, exchange of information through the WAN 201 or other network may occur through one or more high speed connections. In some cases, high speed connections may be over-the-air (OTA), passed through networked systems, directly connected to one or more WANs 201 or directed through one or more routers 202. Router(s) 202 are completely optional and other embodiments in accordance with the present disclosure may or may not utilize one or more routers 202. One of ordinary skill in the art would appreciate that there are numerous ways server 203 may connect to WAN 201 for the exchange of information, and embodiments of the present disclosure are contemplated for use with any method for connecting to networks for the purpose of exchanging information. Further, while this application refers to high speed connections, embodiments of the present disclosure may be utilized with connections of any speed.

Components or modules of the system may connect to server 203 via WAN 201 or other network in numerous ways. For instance, a component or module may connect to the system i) through a computing device 212 directly connected to the WAN 201, ii) through a computing device 205, 206 connected to the WAN 201 through a routing device 204, iii) through a computing device 208, 209, 210 connected to a wireless access point 207 or iv) through a computing device 211 via a wireless connection (e.g., CDMA, GMS, 3G, 4G) to the WAN 201. One of ordinary skill in the art will appreciate that there are numerous ways that a component or module may connect to server 203 via WAN 201 or other network, and embodiments of the present disclosure are contemplated for use with any method for connecting to server 203 via WAN 201 or other network. Furthermore, server 203 could be comprised of a personal computing device, such as a smartphone, acting as a host for other computing devices to connect to.

The communications means of the system may be any means for communicating data, including image and video, over one or more networks or to one or more peripheral devices attached to the system, or to a system module or component. Appropriate communications means may include, but are not limited to, wireless connections, wired connections, cellular connections, data port connections, Bluetooth® connections, near field communications (NFC) connections, or any combination thereof. One of ordinary skill in the art will appreciate that there are numerous communications means that may be utilized with embodiments of the present disclosure, and embodiments of the present disclosure are contemplated for use with any communications means.

Traditionally, a computer program includes a finite sequence of computational instructions or program instructions. It will be appreciated that a programmable apparatus or computing device can receive such a computer program and, by processing the computational instructions thereof, produce a technical effect.

A programmable apparatus or computing device includes one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computing device can include any and all suitable combinations of at least one general purpose computer, special-purpose computer, programmable data processing apparatus, processor, processor architecture, and so on. It will be understood that a computing device can include a computer-readable storage medium and that this medium may be internal or external, removable and replaceable, or fixed. It will also be understood that a computing device can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the disclosure as claimed herein could include an optical computer, quantum computer, analog computer, or the like.

Regardless of the type of computer program or computing device involved, a computer program can be loaded onto a computing device to produce a particular machine that can perform any and all of the depicted functions. This particular machine (or networked configuration thereof) provides a technique for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Illustrative examples of the computer readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A data store may be comprised of one or more of a database, file storage system, relational data storage system or any other data system or structure configured to store data. The data store may be a relational database, working in conjunction with a relational database management system (RDBMS) for receiving, processing and storing data. A data store may comprise one or more databases for storing information related to the processing of moving information and estimate information as well one or more databases configured for storage and retrieval of moving information and estimate information.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software components or modules, or as components or modules that employ external routines, code, services, and so forth, or any combination of these. All such implementations are within the scope of the present disclosure. In view of the foregoing, it will be appreciated that elements of the block diagrams and flowchart illustrations support combinations of means for performing the specified functions, combinations of steps for performing the specified functions, program instruction technique for performing the specified functions, and so on.

It will be appreciated that computer program instructions may include computer executable code. A variety of languages for expressing computer program instructions are possible, including without limitation C, C++, Java, JavaScript, assembly language, Lisp, HTML, Perl, and so on. Such languages may include assembly languages, hardware description languages, database programming languages, functional programming languages, imperative programming languages, and so on. In some embodiments, computer program instructions can be stored, compiled, or interpreted to run on a computing device, a programmable data processing apparatus, a heterogeneous combination of processors or processor architectures, and so on. Without limitation, embodiments of the system as described herein can take the form of web-based computer software, which includes client/server software, software-as-a-service, peer-to-peer software, or the like.

In some embodiments, a computing device enables execution of computer program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computing device can process these threads based on priority or any other order based on instructions provided in the program code.

Unless explicitly stated or otherwise clear from the context, the verbs "process" and "execute" are used interchangeably to indicate execute, process, interpret, compile, assemble, link, load, any and all combinations of the foregoing, or the like. Therefore, embodiments that process computer program instructions, computer-executable code, or the like can suitably act upon the instructions or code in any and all of the ways just described.

The functions and operations presented herein are not inherently related to any particular computing device or other apparatus. Various general-purpose systems may also be used with programs in accordance with the teachings herein, or it may prove convenient to construct more specialized apparatus to perform the required method steps. The required structure for a variety of these systems will be apparent to those of ordinary skill in the art, along with equivalent variations. In addition, embodiments of the disclosure are not described with reference to any particular programming language. It is appreciated that a variety of programming languages may be used to implement the present teachings as described herein, and any references to specific languages are provided for disclosure of enablement and best mode of embodiments of the disclosure. Embodiments of the disclosure are well suited to a wide variety of computer network systems over numerous topologies. Within this field, the configuration and management of large networks include storage devices and computing devices that are communicatively coupled to dissimilar computing and storage devices over a network, such as the Internet, also referred to as "web" or "world wide web".

Throughout this disclosure and elsewhere, block diagrams and flowchart illustrations depict methods, apparatuses (e.g., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "component", "module," or "system."

While the foregoing drawings and description set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

The functions, systems and methods herein described could be utilized and presented in a multitude of languages. Individual systems may be presented in one or more languages and the language may be changed with ease at any point in the process or methods described above. One of ordinary skill in the art would appreciate that there are numerous languages the system could be provided in, and embodiments of the present disclosure are contemplated for use with any language.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed system and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A system, comprising:

a target assembly having a reflective surface;

a plurality of acoustic sensors disposed at the target assembly; and at least one optical sensor;

wherein the target assembly includes sound-absorbing material;

wherein the at least one optical sensor is configured to image a first user and a second user of the system; and wherein the reflective surface is configured to reflect a reflected image of the first user at the second user.

2. The system of claim 1, wherein the target assembly includes a reflective layer including the reflective surface, the sound-absorbing material, and an impact plate.

3. The system of claim 2, wherein the reflective layer is a metalized polyester film or a metalized plastic film.

4. The system of claim 2, wherein the sound-absorbing material is disposed between the reflective layer and the impact plate, and the sound-absorbing material contacts both the reflective layer and the impact plate.

5. The system of claim 1, wherein the at least one optical sensor includes a plurality of stereoscopic cameras.

6. The system of claim 1, wherein the plurality of acoustic sensors includes a plurality of microphones.

7. The system of claim 6, wherein the plurality of microphones is configured to locate a bullet impact point on the target assembly based on time of arrival extraction and triangulation computing.

8. The system of claim 1, further comprising an additional plurality of acoustic sensors disposed at a location facing the reflective surface of the target assembly.

9. The system of claim 8, wherein the additional plurality of acoustic sensors includes a plurality of microphones configured to determine a time at which a firearm is fired and trigger a start of data collection by the plurality of acoustic sensors and the at least one optical sensor.

10. The system of claim 1, wherein the at least one optical sensor is configured to collect data of a barrel of a firearm of the second user when the barrel of the firearm of the second user is pointed toward the reflected image of the first user, the data including spatial coordinates calibrated with the at least one optical sensor.

11. The system of claim 1, wherein the at least one optical sensor includes two stereoscopic cameras configured to collect image data of the first and second users.

12. The system of claim 1, further comprising a direct line-of-sight barrier that is a bulletproof barrier configured to block a direct line-of-sight between the first user and the second user.

13. The system of claim 1, wherein the reflective surface is angled relative to the second user to reflect the reflected image of the first user at the second user.

14. A method, comprising:

using a reflective surface of a target assembly to reflect an image of a first user at a first location to be visible as a reflected image on the reflective surface to a second user at a second location;

acoustically sensing a bullet impact location point on the target assembly of a bullet fired from a firearm of the second user at the reflected image of the first user; and optically sensing a location of the first user and the second user;

wherein acoustically sensing includes digitizing signals from a plurality of acoustic impact sensors, determining a signal time band of the digitized signals, and performing a triangulation calculation using the signal time band.

15. The method of claim 14, further comprising acoustically sensing a time at which the firearm of the second user is fired.

16. The method of claim 14, further comprising optically sensing a location of a barrel of the firearm.

17. The method of claim 14, wherein acoustically sensing and optically sensing are synchronized.

18. The method of claim 14, further comprising disposing a direct line-of-sight barrier between the first user at the first location and the second user at the second location.

19. The method of claim 18, wherein the direct line-of-sight barrier is a bulletproof barrier that prevents projectiles from passing through the bulletproof barrier.

20. The method of claim 14, wherein the reflected image of the first user on the target assembly is visible to the second user as a moving, live reflection of the first user.

21. An impact shot tracking system, comprising:

an impact shot tracking module, comprising computer-executable code stored in non-volatile memory;

a processor;

an acoustic sensor array;

an optical sensor array; and a target assembly;

wherein the impact shot tracking module, the processor, the acoustic sensor array, the optical sensor array, and the target assembly are configured to:

reflect an image of a first user on the target assembly, the reflected image of the first user being visible to a second user;

sense a time at which a firearm of the second user is fired at the reflected image of the first user that is visible to the second user on the target assembly;

sense a projectile impact location point on the target assembly of a projectile fired from the firearm of the second user; and determine a location of the reflected image of the first user on a reflective surface of the target assembly.

22. The impact shot tracking system of claim 21, further comprising using the optical sensor array to sense a location of a barrel of the firearm.

23. The impact shot tracking system of claim 21, wherein the acoustic sensor array senses the time at which the firearm is fired and senses the projectile impact location point.

24. The impact shot tracking system of claim 21, wherein determining the location of the reflected image of the first user on the reflective surface of the target assembly is based on using the optical sensor array to sense a location of the first user.

25. The impact shot tracking system of claim 21, wherein the target assembly includes a reflective surface that is angled relative to the second user to reflect the reflected image of the first user at the second user.

* * * * *